US010254708B2

(12) United States Patent
Itabashi

(10) Patent No.: US 10,254,708 B2
(45) Date of Patent: Apr. 9, 2019

(54) IMAGE FORMING APPARATUS HAVING A DEVELOPING CARTRIDGE WITH A STORAGE MEDIUM AND AN ELECTRICAL CONTACT SURFACE

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 17 days.

(21) Appl. No.: 15/461,574

(22) Filed: Mar. 17, 2017

(65) Prior Publication Data

US 2017/0269544 A1 Sep. 21, 2017

(30) Foreign Application Priority Data

Mar. 18, 2016 (JP) ..... 2016-054699

(51) Int. Cl.
*G03G 21/16* (2006.01)

(52) U.S. Cl.
CPC ..... *G03G 21/1652* (2013.01); *G03G 21/1676* (2013.01)

(58) Field of Classification Search
CPC ..... G03G 21/1652
USPC ..... 399/119
See application file for complete search history.

(56) References Cited

U.S. PATENT DOCUMENTS

2011/0064457 A1 3/2011 Okabe et al.
2011/0129252 A1* 6/2011 Oda ..... G03G 21/1821 399/119
2013/0051849 A1 2/2013 Itabashi et al.

FOREIGN PATENT DOCUMENTS

JP 2011-059510 A 3/2011
JP 2013-054058 A 2/2013

* cited by examiner

*Primary Examiner* — Walter L Lindsay, Jr.
*Assistant Examiner* — Philipmarcus T Fadul
(74) *Attorney, Agent, or Firm* — Scully, Scott, Murphy & Presser, P.C.

(57) ABSTRACT

An image forming apparatus comprises a photosensitive drum, a developing cartridge and a frame. The developing cartridge comprises a casing, a developing roller, a storage medium having an electrical contact surface and a holder holding the electrical contact surface on the first external surface. The frame has an electrical contact. The electrical contact is contact with the electrical contact surface of the developing cartridge in a state that the developing cartridge is attached to the frame. The casing is movable relative to the holder in a separating direction in which the developing roller separates from the photosensitive drum in a state that the electrical contact surface is in contact with the electrical contact.

13 Claims, 16 Drawing Sheets

IMAGE FORMING APPARATUS HAVING A DEVELOPING CARTRIDGE WITH A STORAGE MEDIUM AND AN ELECTRICAL CONTACT SURFACE

CROSS-REFERENCE TO RELATED APPLICATION

This application claims priority from Japanese Patent Application No. 2016-054699, filed on Mar. 18, 2016, which is incorporated herein by reference in its entirety.

TECHNICAL FIELD

The disclosure relates to an image forming apparatus.

BACKGROUND

Known electrophotographic image forming apparatuses include, for example, laser printers and LED printers. A developing cartridge is used in such image forming apparatuses. The developing cartridge includes a developing roller for supplying toner. Some image forming apparatus includes a drawer unit. The drawer unit includes a photosensitive drum. In this case, a developing cartridge is attachable to the drawer unit. In response to attachment of the developing cartridge to the drawer unit, the photosensitive drum and the developing roller contact with each other.

Some developing cartridge is attachable to a drum cartridge. The drum cartridge includes a photosensitive drum. In response to attachment of the developing cartridge to the drum cartridge, the photosensitive drum and the developing roller contact with each other. The drum cartridge having the developing cartridge attached thereto is further attached to the image forming apparatus.

The image forming apparatus performs a separating operation as necessary. In the separating operation, the developing roller is separated from the photosensitive drum temporarily. For example, in a case that a color printer performs monochrome printing, developing rollers of developing cartridges for colors other than black are separated from the respective photosensitive drums in the separating operation. At that time, a position of a housing of each of the developing cartridges relative to the drawer unit or the drum cartridge is changed.

Some other known developing cartridge may include a storage medium. The storage medium may be, for example, an IC chip. The storage medium may include an electrical contact surface. The electrical contact surface of the storage medium may be configured to contact a terminal portion disposed at the image forming apparatus or at the drawer unit. Some further known developing cartridge may include an electrode. The electrode of the developing cartridge may receive electric power from the image forming apparatus. The electrode may also include an electrical contact surface. The electrical contact surface of the electrode may be configured to contact the electrode of the image forming apparatus or the drawer unit.

However, when the image forming apparatus performs the separating operation on the developing cartridge having the electrical contact surface, a relative positional relationship between the electrical contact surface and the terminal portion may be changed in accordance with the change of the housing of the developing cartridge. Therefore, every time the separating operation is performed, the electrical contact surface and the terminal portion may be rubbed against each other.

SUMMARY

Accordingly, some embodiments of the disclosure provide for reduction of a wearing of an electrical contact surface of a developing cartridge in an image forming apparatus in which the developing cartridge including the electrical contact surface is used.

According to an aspect of the disclosures, there is provided an image forming apparatus, comprising: a photosensitive drum rotatable about a first axis extending in a first direction, a developing cartridge and a frame. The developing cartridge comprises a casing configured to store developer therein, a developing roller rotatable about a second axis extending in the first direction, a storage medium having an electrical contact surface and a holder disposed at one end of the casing in the first direction. The holder has a first external surface. The holder holds the electrical contact surface on the first external surface. The casing is movable relative to the holder in a separating direction in which the developing roller separates from the photosensitive drum while the developing cartridge is in a state that the electrical contact surface remains in contact with the electrical contact.

According to another aspect of the disclosures, there is provided an image forming apparatus, comprising a developing cartridge and a frame. The developing cartridge comprises a casing configured to storing developer therein, a developing roller rotatable about an axis extending in a first direction, a storage medium having an electrical contact surface and a holder disposed at one end of the casing in the first direction, the holder extending in a second direction intersecting with the electrical contact surface. The holder has a first external surface disposed at one end of the holder in the second direction. The holder holds the electrical contact surface on the first external surface. The frame comprises an electrical contact. The electrical contact is in contact with the electrical contact surface of the developing cartridge in a state that the developing cartridge is attached to the frame. The casing is movable relative to the holder in the inserted direction in a state that the electrical contact surface is in contact with the electrical contact.

According to another aspect of the disclosures, there is provided an image forming apparatus, comprising According to another aspect of the disclosures, there is provided an image forming apparatus, comprising a developing cartridge and a frame. The developing cartridge comprises a casing configured to storing developer therein, a developing roller, an electrical contact surface and a holder holding the electrical contact surface. The developing cartridge is attachable to a frame. The frame comprises an electrical contact, the electrical contact being in contact with the electrical contact surface of the developing cartridge in a state that the developing cartridge is attached to the frame. The casing is movable relative to the holder where the electrical contact surface faces electrical contact in a state that the electrical contact surface is in contact with the electrical contact.

According to the one or more aspects of the disclosure, while the electrical contact surface and the electrical contact are kept in contact with each other, the housing is movable relative to the holder. Accordingly, a wearing of the electrical contact surface is reduced.

BRIEF DESCRIPTION OF THE DRAWINGS

For a more complete understanding of the present disclosure, and the objects, features, and advantages thereof, reference now is made to the following descriptions taken in connection with the accompanying drawings.

DETAILED DESCRIPTION

Figure 1:
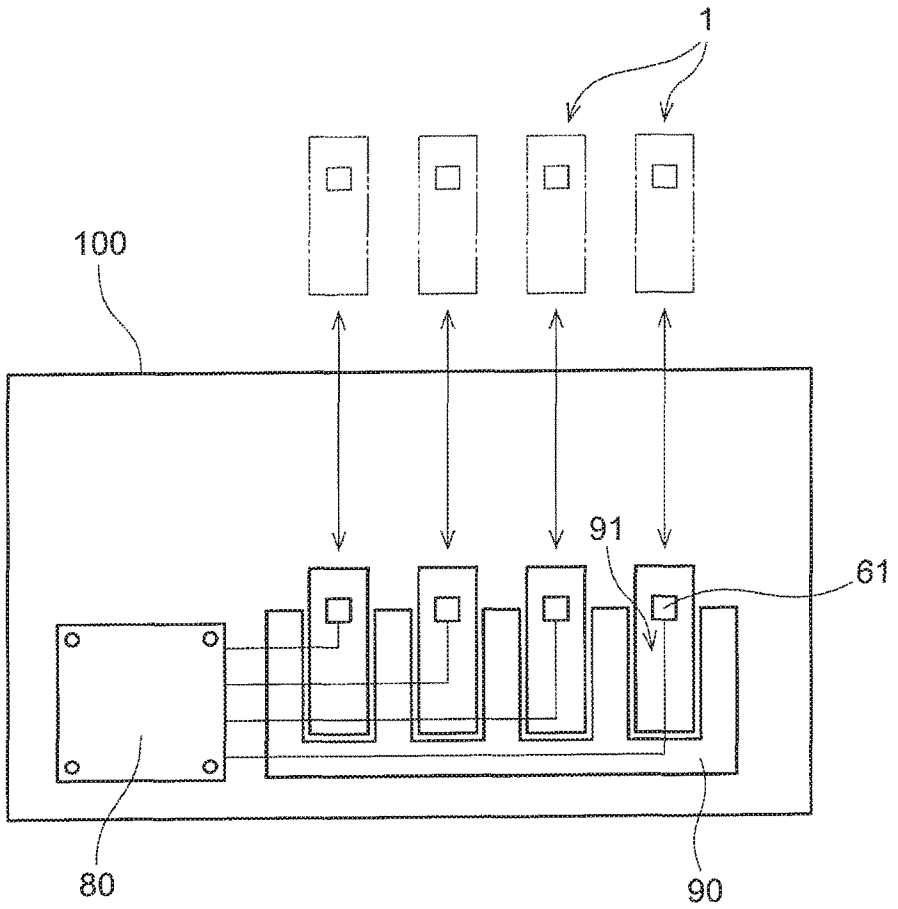
FIG. 1 is a conceptual diagram depicting an image forming apparatus in an illustrative embodiment according to one or more aspects of the disclosure.

Hereinafter, an illustrative embodiment will be described in detail with reference to the accompanying drawing, like reference numerals being used for like corresponding parts in the various drawings.

<1. Configuration of Image Forming Apparatus>

FIG. 1 is a conceptual diagram depicting an image forming apparatus 100. The image forming apparatus 100 is an electrophotographic printer. The electrophotographic printer includes, for example, a laser printer and an LED printer. The image forming apparatus 100 includes a plurality of, for example, four, developing cartridges 1, and a drawer unit 90. The drawer unit 90 is a frame to which the developing cartridges 1 are attachable. The image forming apparatus 100 forms an image onto a recording surface of a recording sheet using developer (e.g., toner) supplied from each of the developing cartridges 1.

Figure 2:
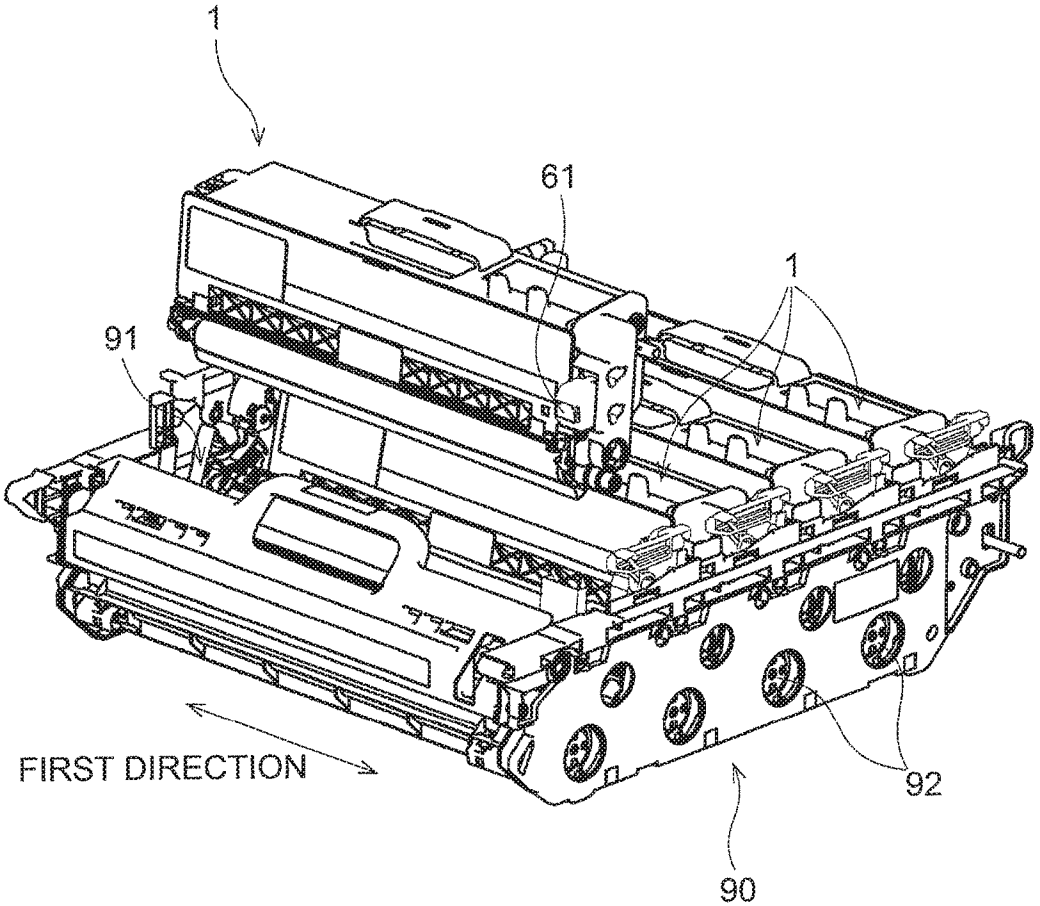
FIG. 2 is a perspective view depicting a drawer unit and developing cartridges in the illustrative embodiment according to one or more aspects of the disclosure.

FIG. 2 is a perspective view depicting the drawer unit 90 and the developing cartridges 1. As depicted in FIGS. 1 and 2, the developing cartridges 1 are replaceable individually with respect to the drawer unit 90. At the time of replacing one or more of the developing cartridges 1, the drawer unit 90 is drawn out from the front of the image forming apparatus 100. The one or more developing cartridges 1 are detached from and replaced with new ones individually in respective slots 91 of the drawer unit 90. The drawer unit 90 includes a plurality of, for example, four, photosensitive drums 92. The photosensitive drums 92 are disposed in the proximity of the bottoms of the respective slots 91. The photosensitive drums 92 are rotatable on respective rotation axes (e.g., first axes) extending horizontally. Hereinafter, the direction in which the rotation axis of each of the photosensitive drums 92 extends is referred to as a "first direction".

In the illustrative embodiment, four developing cartridges 1 are attachable to a single drawer unit 90. The developing cartridges 1 store therein developer of respective different colors (e.g., cyan, magenta, yellow, and black). Nevertheless, in other embodiments, for example, the number of developing cartridges 1 attached to the drawer unit 90 is less than four or more than four.

As depicted in FIGS. 1 and 2, each of the developing cartridges 1 includes an IC chip 61. The IC chip 61 is a storage medium from which information can be read and into which information can be written. The image forming apparatus 100 further includes a controller 80. In response to attachment of the developing cartridges 1 to the drawer unit 90, the IC chip 61 of each of the developing cartridges 1 and the controller 80 come into connection with each other electrically. The controller 80 is, for example, a circuit board. The controller 80 includes a processor, e.g., a central processing unit ("CPU"), and various memories. The controller 80 executes various processing in the image forming apparatus 100 by operation of the processor in accordance with one or more software programs.

<2. Overall Configuration of Developing Cartridges>

Figure 3:
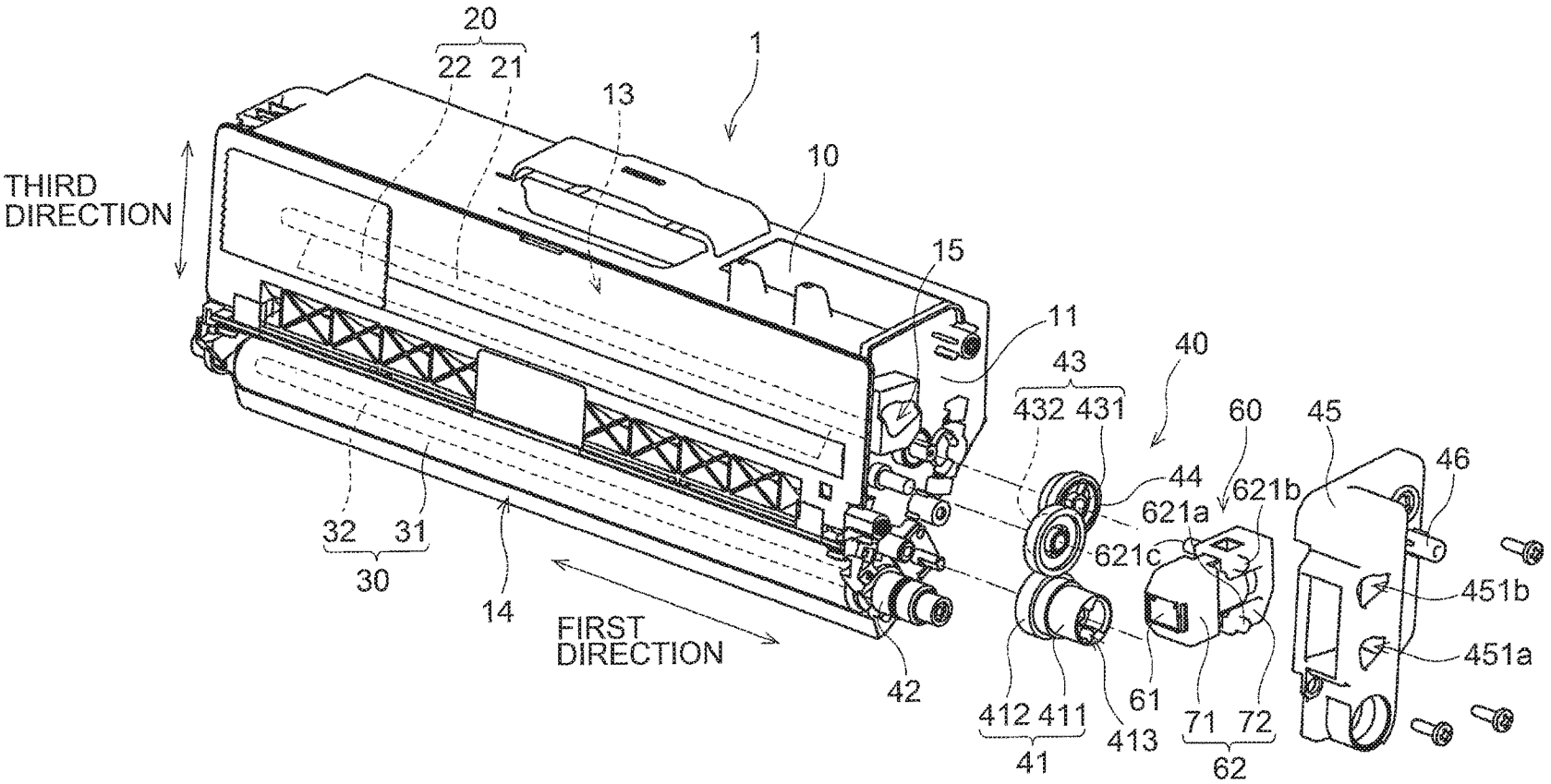
FIG. 3 is a perspective view depicting one of the developing cartridges in the illustrative embodiment according to one or more aspects of the disclosure.
Figure 4:
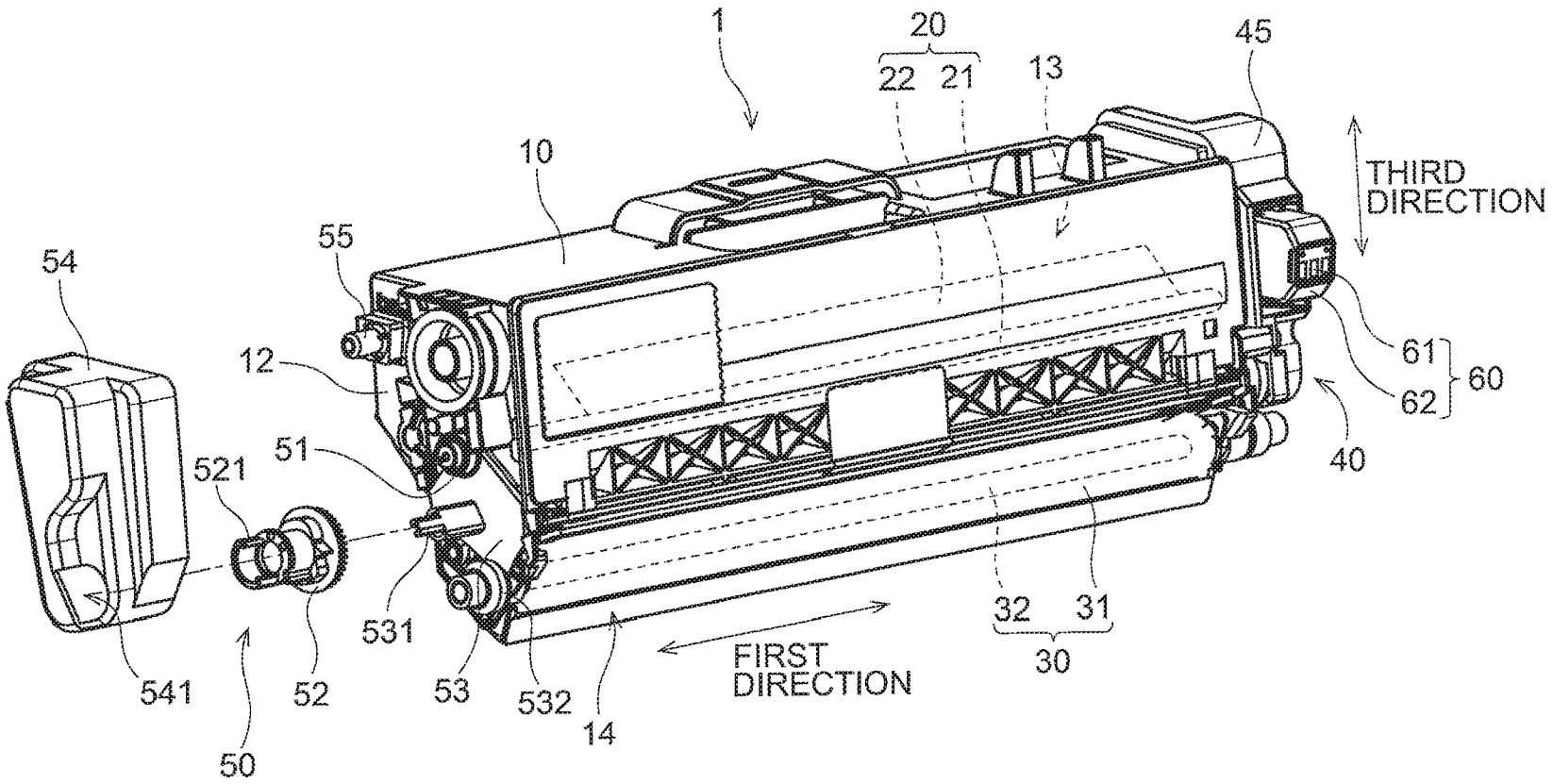
FIG. 4 is a perspective view depicting one of the developing cartridges in the illustrative embodiment according to one or more aspects of the disclosure.

FIGS. 3 and 4 are perspective views depicting one of the developing cartridges 1. All of the developing cartridges 1 may have the same or similar configuration and behave in the same or similar manner, and therefore, the description is provided with respect to one of the developing cartridges 1. As depicted in FIGS. 3 and 4, the developing cartridge 1 includes a casing 10, an agitator 20, a developing roller 30, a first gear unit 40, a second gear unit 50, and an IC chip assembly 60.

The casing 10 is a housing capable of storing developer therein. The casing 10 extends in the first direction between a first end face 11 and a second end face 12 thereof. The first gear unit 40 and the IC chip assembly 60 are disposed at the first end face 11. The second gear unit 50 is disposed at the second end face 12. The casing 10 includes a storage chamber 13 therein. Developer is stored in the storage chamber 13. The casing 10 has an opening 14. For example, the casing 10 has the opening 14 at an end thereof which faces toward the drawer unit 90 when the developing cartridge 1 is inserted to the drawer unit 90. The storage chamber 13 and the outside of the casing 10 are in communication with each other through the opening 14.

The agitator 20 includes an agitator shaft 21 and an agitator blade 22. The agitator shaft 21 extends along the first direction. The agitator blade 22 outwardly extends from the agitator shaft 21 in a diameter direction of the agitator shaft 21. At least a portion of the agitator shaft 21, and the agitator blade 22 are positioned inside the storage chamber 13. The agitator shaft 21 has a first agitator gear 44 and a second agitator gear 51 attached to its respective end portions in the first direction. Therefore, the agitator shaft 21 and the agitator blade 22 rotate together with the first agitator gear 44 and the second agitator gear 51. The agitator blade 22 rotates to agitate developer stored in the storage chamber 13.

The developing roller 30 is rotatable on a rotation axis (e.g., a second axis) extending in the first direction. The developing roller 30 is disposed at the opening 14 of the casing 10. The developing roller 30 includes a roller body 31 and a roller shaft 32. The roller body 31 is be a hollow cylindrical member extending in the first direction. The roller body 31 is made of, for example, rubber having elasticity. The roller shaft 32 is a solid cylindrical member passing through the roller body 31 in the first direction. The roller shaft 32 is made of, for example, metal or conductive resin. The roller body 31 is fixed to the roller shaft 32 so as not to rotate relative to the roller shaft 32.

The roller shaft 32 has one end portion in the first direction. The end portion of the roller shaft 32 is fixed to the developing roller gear 42 so as not to rotate relative to the developing roller gear 42. Therefore, in response to rotation of the developing roller gear 42, the roller shaft 32 rotates and thus the roller body 31 rotates together with the roller shaft 32.

Nevertheless, the roller shaft 32 might not necessarily pass through the roller body 31 in the first direction. In other embodiments, for example, the roller shaft 32 may extend along the first direction from each end of the roller body 31 in the first direction.

The developing cartridge 1 includes a supply roller. The supply roller is disposed between the developing roller 30 and the storage chamber 13. The supply roller is rotatable on a rotation axis extending in the first direction. In response to reception of a driving force in the developing cartridge 1, developer is supplied onto an circumferential surface of the developing roller 30 from the storage chamber 13 of the casing 10 via the supply roller. At that time, developer is frictionally charged between the supply roller and the developing roller 30. The roller shaft 32 of the developing roller 30 is applied with a bias voltage. Therefore, static electricity building between the roller shaft 32 and developer attracts developer to an circumferential surface of the roller body 31.

The developing cartridge 1 includes a layer-thickness regulating blade (not depicted). The layer-thickness regulating blade makes developer have a certain thickness on the circumferential surface of the roller body 31. Then, developer on the circumferential surface of the roller body 31 is supplied onto a corresponding photosensitive drum 92 disposed at the drawer unit 90. At that time, developer moves from the roller body 31 to the photosensitive drum 92 in accordance with an electrostatic latent image formed on an circumferential surface of the photosensitive drum 92. Thus, the electrostatic latent image is visualized on the circumferential surface of the photosensitive drum 92.

The first gear unit 40 is disposed at the first end face 11 of the casing 10. FIG. 3 is a perspective view of the developing cartridge 1 in which the first gear unit 40 is disassembled. As depicted in FIG. 3, the first gear unit 40 includes a coupling 41, a developing roller gear 42, an idle gear 43, the first agitator gear 44, and a first cover 45. In FIG. 3, gear teeth are omitted in each gear.

The coupling 41 is a gear configured to receive a driving force from the image forming apparatus 100 prior to the other gears. The coupling 41 is rotatable on a rotation axis extending in the first direction. The coupling 41 includes a coupling portion 411 and a coupling gear 412. The coupling portion 411 and the coupling gear 412 is made of, for example, resin and is inseparable from each other. The coupling portion 411 has an engagement hole 413 recessed in the first direction. The coupling gear 412 has teeth on its entire circumference at equal pitches.

In response to placement of the drawer unit 90 having the developing cartridges 1 attached thereto in the image forming apparatus 100, a drive shaft of the image forming apparatus 100 moves into the engagement hole 413 of the coupling portion 411. Thus, the drive shaft and the coupling portion 411 are coupled to each other so as not to rotate relative to each other. Therefore, the drive shaft, the coupling portion 411 rotates and thus the coupling gear 412 rotates together with the coupling portion 411.

The developing roller gear 42 is configured to rotate the developing roller 30. The developing roller gear 42 is rotatable on a rotation axis extending in the first direction. The developing roller gear 42 has teeth on its entire circumference at equal pitches. The coupling gear 412 and the developing roller gear 42 are in mesh with each other through their interlocking teeth. The developing roller gear 42 is fixed to one end portion of the roller shaft 32 in the first direction so as not to rotate relative to the roller shaft 32. Therefore, in response to rotation of the coupling gear 412, the developing roller gear 42 rotates and thus the developing roller 30 rotates together with the developing roller gear 42.

The idle gear 43 is configured to transmit rotation of the coupling gear 412 to the first agitator gear 44. The idle gear 43 is rotatable on a rotation axis extending in the first direction. The idle gear 43 includes a large-diameter gear portion 431 and a small-diameter gear portion 432, which are arranged side by side in the first direction. The small-diameter gear portion 432 is disposed between the large-diameter gear portion 431 and the first end face 11 of the casing 10. In other words, the large-diameter gear portion 431 is farther from the first end face 11 than the small-diameter gear portion 432. The small-diameter gear portion 432 has an addendum circle diameter smaller than an addendum circle diameter of the large-diameter gear portion 431. The large-diameter gear portion 431 and the small-diameter gear portion 432 is made of, for example, resin and be inseparable from each other.

Each of the large-diameter gear portion 431 and the small-diameter gear portion 432 has teeth on its entire circumference at equal pitches. The small-diameter gear portion 432 has teeth less than teeth of the large-diameter gear portion 431. The coupling gear 412 and the large-diameter gear portion 431 are in mesh with each other through their interlocking teeth. The small-diameter gear portion 432 and the first agitator gear 44 are in mesh with each other through their interlocking teeth. In response to rotation of the coupling gear 412, the large-diameter gear portion 431 rotates and thus the small-diameter gear portion 432 rotates together with the large-diameter gear portion 431. In response to rotation of the small-diameter gear portion 432, the first agitator gear 44 rotates.

The first agitator gear 44 is configured to rotate the agitator 20 in the storage chamber 13. The first agitator gear 44 is rotatable on a rotation axis extending in the first direction. The first agitator gear 44 has teeth on its entire circumference at equal pitches. As described above, the small-diameter gear portion 432 and the first agitator gear 44 are in mesh with each other through their interlocking teeth. The first agitator gear 44 is fixed to one end portion of the agitator shaft 21 in the first direction so as not to rotate relative to the agitator shaft 21. Therefore, in response to transmission of a driving force to the first agitator gear 44 from the coupling 41 via the idle gear 43, the first agitator gear 44 rotates and thus the agitator 20 rotates together with the first agitator gear 44.

The first cover 45 is fixed to the first end face 11 of the casing 10, by screws, for example. The coupling gear 412, the developing roller gear 42, the idle gear 43, and the first agitator gear 44 are accommodated in the first cover 45 while being positioned between the first end face 11 and the first cover 45. The engagement hole 413 of the coupling portion 411 is exposed to the outside of the first cover 45. The first cover 45 includes a first cylindrical protrusion 46 extending in the first direction. The first cover 45 also serves as a holder cover for holding a holder 62 of the IC chip assembly 60.

The second gear unit 50 is disposed at the second end face 12 of the casing 10. FIG. 4 is a perspective view of the developing cartridge 1 in which the second gear unit 50 is disassembled. As depicted in FIG. 4, the second gear unit 50 includes the second agitator gear 51, a detection gear 52, a conductive member 53, and a second cover 54. In FIG. 4, gear teeth are omitted in the second agitator gear 51.

The second agitator gear 51 is configured to transmit rotation of the agitator shaft 21 to the detection gear 52. The second agitator gear 51 is rotatable on a rotation axis extending in the first direction. The second agitator gear 51 has teeth on its entire circumference at equal pitches. In a state where the developer cartridge 1 has not been used yet, the second agitator gear 51 and the detection gear 52 are capable of meshing with each other through their interlocking teeth. The second agitator gear 51 is fixed to the other end of the agitator shaft 21 in the first direction so as not to rotate relative to the agitator shaft 21. Therefore, in response to rotation of the agitator shaft 21, the second agitator gear 51 rotates.

The detection gear 52 is configured to allow the image forming apparatus 100 to obtain therethrough information on the developing cartridge 1. The information on the developing cartridge 1 includes information on whether the developing cartridge 1 is a completely new (or not-yet-used) developing cartridge or a used developing cartridge. The information on the developing cartridge 1 further includes specifications of the developing cartridge 1. The specifications of the developing cartridge 1 include, for example, yield information representing an amount of developer stored in the developing cartridge 1 or the number of sheets printable by developer stored in the developing cartridge 1.

The detection gear 52 is rotatable on a rotation axis extending in the first direction. The detection gear 52 has teeth on a portion of its circumference. In response to placement of the drawer unit 90 having a completely new developing cartridge 1 attached thereto inside the image forming apparatus 100, the coupling 41 receives a driving force from the image forming apparatus 100. The second agitator gear 51 rotates upon receipt of the driving force from the coupling 41 via the idle gear 43, the first agitator gear 44, and the agitator 20. The detection gear 52 rotates through meshing with the second agitator gear 51. As described above, the detection gear 52 has teeth on only a particular portion of its circumference. With this configuration, after the detection gear 52 rotates by a predetermined angle, the second agitator gear 51 and the detection gear 52 become disengaged from each other and thus the detection gear 52 stops rotating.

As described above, in the developing cartridge 1 that has been used once in the image forming apparatus 100, the second agitator gear 51 and the detection gear 52 are not in mesh with each other. Therefore, in a case that the once used developing cartridge 1 is reused in the image forming apparatus 100, rotation of the second agitator gear 51 might not be transmitted to the detection gear 52. Accordingly, the detection gear 52 might not rotate.

Nevertheless, in other embodiments, for example, another gear is disposed between the second agitator gear 51 and the detection gear 52. In one example, the second gear unit 50 may further include a second idle gear which is in mesh with both the second agitator gear 51 and the detection gear 52 with their interlocking teeth. Rotation of the second agitator gear 51 is transmitted to the detection gear 52 via the second idle gear.

As depicted in FIG. 4, the detection gear 52 includes a detection protrusion 521. The detection protrusion 521 protrudes in the first direction. The detection protrusion 521 may have an arc shape with respect to the rotation axis of the detection gear 52. In response to rotation of the detection gear 52, the detection protrusion 521 rotates. That is, the position of the detection protrusion 521 changes in accordance with rotation of the detection gear 52.

The conductive member 53 is made of, for example, conductive metal or conductive resin. The conductive member 53 is disposed at the second end face 12 of the casing 10. The conductive member 53 includes a gear shaft 531. The gear shaft 531 protrudes in the first direction from the conductive member 53 and has a hollow cylindrical shape. The detection gear 52 rotates on the gear shaft 531 while being supported by the gear shaft 531. The detection protrusion 521 partially covers a circumference surface of the gear shaft 531. The conductive member 53 includes a bearing portion 532. The bearing portion 532 is in contact with the roller shaft 32 of the developing roller 30.

The drawer unit 90 includes a conductive lever (not depicted) and an optical sensor (not depicted). The conductive lever is capable of contacting the gear shaft 531. Contact of the conductive lever with the gear shaft 531 brings the conductive member 53 and the roller shaft 32 into electrical conduction with the conductive lever. While the image forming apparatus 100 is driven, the roller shaft 32 is kept at a predetermined bias voltage by electric power supplied from the conductive lever.

The detection protrusion 521 partially covers the circumferential surface of the gear shaft 531. Therefore, while the detection gear 52 rotates after the completely new developing cartridge 1 is attached to the drawer unit 90, a contacting state of the conductive lever and the gear shaft 531 changes in accordance with the shape of the detection gear 52. That is, the conductive lever comes separate from the gear shaft 531 temporarily. The image forming apparatus 100 detects the positional change of the conductive lever by the optical sensor. The controller 80 of the image forming apparatus 100 determines, based on a detection signal obtained from the optical sensor, whether the developing cartridge 1 is a completely new developing cartridge or not and the specifications of the developing cartridge 1.

As described above, in the illustrative embodiment, the optical sensor detects the movement of the detection protrusion 521 via the conductive lever. Nevertheless, in other embodiments, for example, the optical sensor may detect the movement of the detection protrusion 521 directly. In other embodiments, for example, a magnetic sensor or a contact sensor is used instead of the optical sensor. In other embodiments, for example, the movement of the detection protrusion 521 is detected based on whether electrical conduction is established between the conductive lever and the gear shaft 531.

In the illustrative embodiment, the gear shaft 531 constitutes a portion of the conductive member 53. Nevertheless, in other embodiments, for example, a gear shaft is disposed at another location out of the route for supplying electric power to the conductive member 53. In this case, for example, the casing 10 may further include a through hole penetrating the second end face 12 and a cap attached to the through hole. The gear shaft may extend from the cap in the first direction.

In other embodiments, for example, the detection protrusion 521 is disposed at another position of the detection gear 52 in a circumferential direction of the detection gear 52 and may have a different dimension in the circumferential direction of the detection gear 52 from the dimension of the detection protrusion 521 depicted in FIG. 4. In other embodiments, for example, the detection gear 52 may include a plurality of detection protrusions 521. The number of detection protrusions 521, the position of each detection protrusion 521 in the circumferential direction, the dimension of each detection protrusion 521 in the circumferential direction, and the dimension of each detection protrusion 521 in a diameter direction of the detection gear 52 differ in accordance with the specifications of the developing cartridges 1. Thus, variety of the detection protrusions 521 is increased in the number and shape, whereby various developing cartridges 1 having respective different specifications are prepared for the image forming apparatus 100.

In other embodiments, for example, the detection gear 52 may consist of a plurality of members. In one example, the detection gear 52 and the detection protrusion 521 are separate members. A detection gear may include a gear body, and an auxiliary member. A position of the auxiliary member changes in accordance with rotation of the gear body. The auxiliary member may change the position of the conductive lever. In another example, a detection gear may include a gear body, a cam, and a detection protrusion. The cam may rotate in accordance with rotation of the gear body. The detection protrusion may move in accordance with rotation of the cam.

In other embodiments, for example, the detection gear 52 is a movable gear that is movable in the first direction in accordance with its rotation. The second agitator gear 51 and the detection gear 52 become disengaged from each other as a result of movement of the detection gear 52 in the first direction. In this case, the detection protrusion 521 may have teeth on its entire circumference. The detection gear 52 may move in either direction, toward or away from the second end face 12, with respect to the first direction.

The second cover 54 is fixed to the second end face 12 of the casing 10 by screws, for example. The second agitator gear 51, the detection gear 52, and the conductive member 53 are accommodated in the second cover 54 while being positioned between the second end face 12 and the second cover 54. The second cover 54 has an opening 541. The opening 541 exposes a portion of the detection protrusion 521 and a portion of the gear shaft 531 therethrough. The conductive lever is configured to contact the detection gear 52 or the gear shaft 531 via the opening 541.

As depicted in FIG. 4, the casing 10 further includes a second cylindrical protrusion 55. The second cylindrical protrusion 55 protrudes from the second end face 12 of the casing 10 in the first direction. The second cylindrical protrusion 55 is exposed to the outside at the second cover 54.

<3. IC Chip Assembly>

Figure 5:
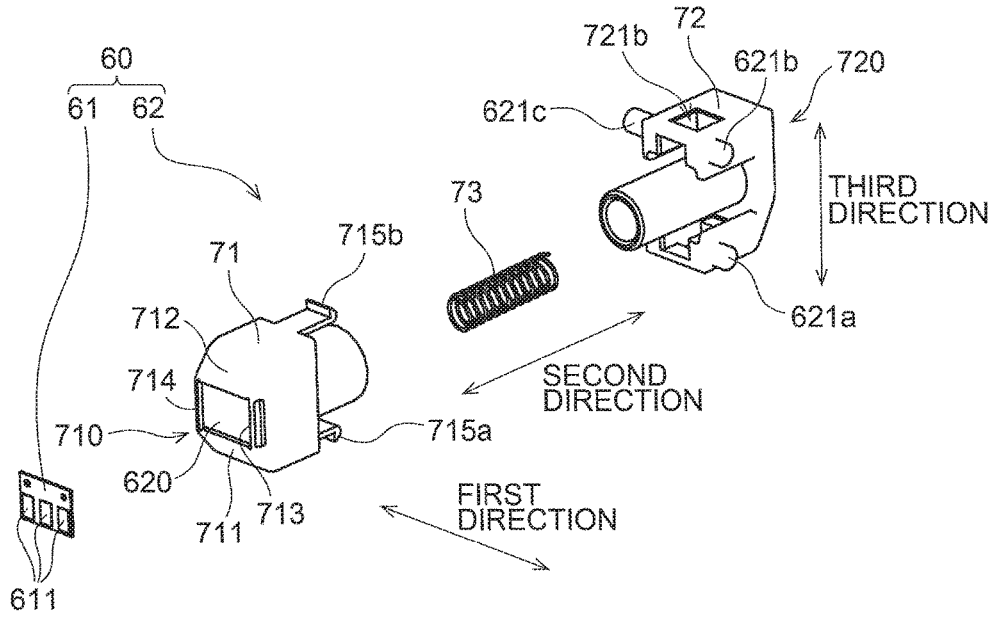
FIG. 5 is a disassembled perspective view depicting an IC (Integrated Circuit) chip assembly according to one or more aspects of the disclosure.
Figure 6:
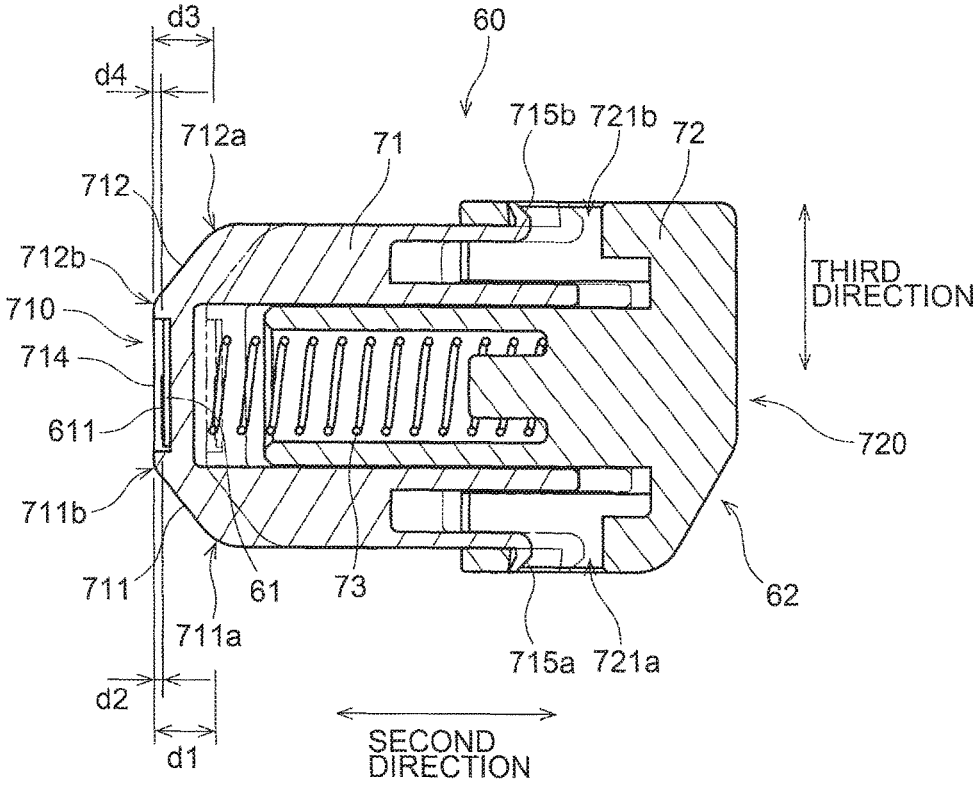
FIG. 6 is a sectional view depicting the IC chip assembly in the illustrative embodiment according to one or more aspects of the disclosure.

The IC chip assembly 60 is disposed at an exterior surface of the first end face 11 of the casing 10. FIG. 5 is a disassembled perspective view depicting the IC chip assembly 60. FIG. 6 is a sectional view depicting the IC chip assembly 60 cut along a plane orthogonal to the first direction. As depicted in FIGS. 3, 4, 5, and 6, the IC chip assembly 60 includes the IC chip 61 and the holder 62. The IC chip 61 is a storage medium. The holder 62 holds the IC chip 61. The IC chip 61 is fixed to an exterior surface of the holder 62. The holder 62 is retained between the casing 10 and the first cover 45. The IC chip 61 includes electrical contact surfaces 611. The electrical contact surfaces 611 is made of, for example, conductive metal. The IC chip 61 is capable of storing various information regarding the developing cartridge 1.

Hereinafter, a direction intersecting a direction in which the electrical contact surfaces 611 extend (e.g., a direction orthogonal to the direction in which the electrical contact surfaces 611 extend) is referred to as a "second direction". A direction in which the developing cartridge 1 is inserted and removed with respect to a corresponding slot 91 of the drawer unit 90 is referred to as a "third direction". An angle between the second direction and the electrical contact surfaces 611 is 75 degrees or greater, preferably 85 or greater, 105 degrees or less, preferably 95 degrees or less.

The holder 62 is partially covered by the first cover 45. The holder 62 has a surface facing the casing 10 and another surface opposite thereto. The holder 62 includes a first boss 621*a*, a second boss 621*b*, and a third boss 621*c*. The first boss 621*a* and the second boss 621*b* protrude in the first direction toward the first cover 45 from the surface opposite to the surface facing the casing 10 in the holder 62. The first boss 621*a* and the second boss 621*b* are positioned side by side in the third direction. As depicted in FIG. 3, the first cover 45 has a first through hole 451*a* and a second through hole 451*b*. The first through hole 451*a* and the second through hole 451*b* penetrate the first cover 45 in the first direction. The first through hole 451*a* and the second through hole 451*b* are positioned side by side in the third direction. The first boss 621*a* is positioned in the first through hole 451*a* and the second boss 621*b* is positioned in the second through hole 451*b* in the assembled state.

The third boss 621*c* protrudes in the first direction toward the casing 10 from the surface facing the casing 10 in the holder 62. The casing 10 has a recessed portion 15. The recessed portion 15 is recessed in the first direction relative to the first end face 11 of the casing 10. The third boss 621*c* is positioned in the recessed portion 15 in the assembled state. The first boss 621*a*, the second boss 621*b*, and the third boss 621*c* may have a circular cylindrical shape or another shape, for example, a rectangular cylindrical shape.

The first through hole 451*a* has a dimension (e.g., an inside diameter) larger than a dimension (e.g., an outside diameter) of the first boss 621*a* in the second direction. The second through hole 451*b* has a dimension (e.g., an inside diameter) larger than a dimension (e.g., an outside diameter) of the second boss 621*b* in the second direction. The recessed portion 15 has a dimension (e.g., an inside diameter) larger than a dimension (e.g., an outside diameter) of the third boss 621*c* in the second direction. With this configuration, the holder 62 is movable in the second direction together with the first boss 621*a*, the second boss 621*b*, and the third boss 621*c* relative to the casing 10 and the first cover 45. In response to movement of the holder 62 in the second direction, the IC chip 61 having the electrical contact surfaces 611 moves in the second direction together with the holder 62.

The first through hole 451*a* has a dimension (e.g., the inside diameter) larger than a dimension (e.g., the outside diameter) of the first boss 621*a* in the third direction. The second through hole 451*b* has a dimension (e.g., the inside diameter) larger than a dimension (e.g., the outside diameter) of the second boss 621*b* in the third direction. The recessed portion 15 has a dimension (e.g., an inside diameter) larger than a dimension (e.g., the outside diameter) of the third boss 621*c* in the third direction. With this configuration, the holder 62 is movable in the third direction together with the first boss 621*a*, the second boss 621*b*, and the third boss 621*c* relative to the casing 10 and the first cover 45. In response to movement of the holder 62 in the third direction, the IC chip 61 having the electrical contact surfaces 611 moves in the third direction together with the holder 62.

Nevertheless, in other embodiments, for example, the holder 62 is movable in the first direction between the first end face 11 of the casing 10 and the first cover 45. The number of bosses of the holder 62, the number of through holes in the first cover 45, and the number of recesses in the casing 10 are not limited to the specific examples. In other embodiments, for example, the first cover 45 may have one or more recesses for receiving one or more bosses, instead of having one or more through holes.

As depicted in FIGS. 5 and 6, the holder 62 has a first external surface 710 and a second external surface 720. The first external surface 710 constitutes one end of the holder 62 in the second direction. The second external surface 720 constitutes the other end of the holder 62 in the second direction. The second external surface 720 is movable in the second direction relative to the first external surface 710.

More specifically, for example, the holder 62 includes a first holder member 71, a second holder member 72, and a coil spring 73. The coil spring 73 is disposed between the first holder member 71 and the second holder member 72. The first holder member 71 is made of, for example, resin. The second holder member 72 is made of, for example, resin. The first holder member 71 includes the first external surface 710. The IC chip 61 is fixed to a holding surface 620 included in the first external surface 710. The second holder member 72 includes the second external surface 720. The first external surface 710 and the second external surface 720 are spaced in the second direction in the assembled holder 62.

The coil spring 73 is an elastic member extending in the second direction. The coil spring 73 is disposed between the first external surface 710 and the second external surface 720 in the second direction. The coil spring 73 is capable of expanding and contracting in the second direction at least between a first state and a second state in which the coil spring 73 contracts further than the coil spring 73 in the first state. The coil spring 73 in the first state is longer than the coil spring 73 in the second state in the second direction. Therefore, a distance between the first external surface 710 and the second external surface 720 in the second direction when the coil spring 73 is in the first state is longer than the distance between the first external surface 710 and the second external surface 720 in the second direction when the coil sprint 73 is in the second state. When the coil spring 73 is in the second state, the length of the coil spring 73 in the second direction is shorter than a natural length of the coil spring 73.

As depicted in FIGS. 5 and 6, the first holder member 71 includes a first hook 715*a* and a second hook 715*b*. The first hook 715*a* and the second hook 715*b* extend from respective portions of the first holder member 71 in the third direction. The second holder member 72 has a first opening 721*a* and a second opening 721*b*. The first hook 715*a* is positioned in the first opening 721*a* in the assembled holder 62. The second hook 715*b* is positioned in the second opening 721*b* in the assembled holder 62. When the coil spring 73 is in the first state, the first hook 715*a* is in contact with the second holder member 72 at an edge of the first opening 721*a* closer to the first external surface 710. When the coil spring 73 is in the first state, the second hook 715*b* is in contact with the second holder member 72 at an edge of the second opening 721*b* closer to the first external surface 710. Therefore, the length of the coil spring 73 in the second direction might not become longer than the length of the coil spring 73 in the first state, and disengagement of the first holder member 71 from the second holder member 72 is avoided. When the coil spring 73 is in the second state, the first hook 715*a* and the second hook 715*b* are separated from the respective edges of the first opening 721*a* and the second opening 721*b* of the second holder member 72.

Nevertheless, in other embodiments, for example, the second holder member 72 may have recesses or stepped portions contactable with the first hook 715*a* and the second hook 715*b*. In other embodiments, for example, the first holder member 71 may have openings, recesses, or stepped portions and the second holder member 72 may include hooks.

The difference in dimensions between the first through hole 451*a* and the first boss 621*a*, between the second through hole 451*b* and the second boss 621*b*, and between the recessed portion 15 and the third boss 621*c*, and expansion and contraction of the coil spring 73 may allow the holding surface 620 the holder 62 to move in the second direction relative to the casing 10.

Hereinafter, the position of the holding surface 620 relative to the casing 10 in the second direction before the developing cartridge 1 is attached to the drawer unit 90 is referred to as an "initial position". The position of the holding surface 620 relative to the casing 10 in the second direction at an instant when the coil spring 73 contracts maximum during attachment of the developing cartridge 1 to the drawer unit 90 is referred to as an "intermediate position". The position of the holding surface 620 relative to the casing 10 in the second direction when a set of the electrical contact surfaces 611 is in contact with a terminal portion 913 is referred to as a "contacting position". The position of the holding surface 620 relative to the casing 10 in the second direction after the attachment of the developing cartridge 1 to the drawer unit 90 is completed is referred to as a "final position".

The first external surface 710 includes a first surface 711, a second surface 712, a third surface 713, and a fourth surface 714 as well as the holding surface 620.

The first surface 711 is disposed at one of opposite sides of the holding surface 620 in the third direction, and the one side is closer to the developing roller 30 than the other side. The first surface 711 is angled relative to the electrical contact surfaces 611 of the IC chip 61 held by the holding surface 620.

One end of the first external surface 710 in the third direction is referred to as a first far position 711*a*. One end of the holding surface 620 in the third direction is referred to as a first near position 711*b*. As depicted in FIG. 6, the first surface 711 extends toward the electrical contact surfaces 611 from the first far position 711*a* to the first near position 711*b*. With respect to both of the second direction and the third direction, the first far position 711*a* is farther from the electrical contact surfaces 611 than the first near position 711*b*. As depicted in FIG. 6, a distance d1 between the first far position 711*a* and the first near position 711*b* in the second direction is greater than a distance d2 between the set of the electrical contact surfaces 611 and the first near position 711*b* in the second direction.

The second surface 712 is disposed at the other of the opposite sides of the holding surface 620 in the third direction, and the other side is farther from the developing roller 30 than the one side. The second surface 712 is angled relative to the electrical contact surfaces 611 of the IC chip 61 held by the holding surface 620.

The other end of the first external surface 710 in the third direction is referred to as a second far position 712*a*. The other end of the holding surface 620 in the third direction is referred to as a second near position 712*b*. As depicted in FIG. 6, the second surface 712 extends toward the electrical contact surfaces 611 from the second far position 712*a* to the second near position 712*b*. With respect to both of the second direction and the third direction, the second far position 712*a* is farther from the electrical contact surfaces 611 than the second near position 712*b*. As depicted in FIG. 6, a distance d3 between the second far position 712*a* and the second near position 712*b* in the second direction is greater than a distance d4 between the set of the electrical contact surfaces 611 and the second near position 712*b* in the second direction.

The third surface 713 is disposed on one of opposite sides of the set of the electrical contact surfaces 611 in the first direction. The fourth surface 714 is disposed on the other of the opposite sides of the set of the electrical contact surfaces 611 in the first direction. Each of the third surface 713 and the fourth surface 714 extends in the third direction. The electrical contact surfaces 611 are disposed at a portion recessed toward the coil spring 73 relative to the third surface 713 and the fourth surface 714. That is, with respect to the second direction, the third surface 713 and the fourth surface 714 are farther from the coil spring 73 than the electrical contact surfaces 611.

The first surface 711, the second surface 712, the third surface 713, and the fourth surface 714 are flat surfaces or curved surfaces. It is preferable that the first surface 711, the second surface 712, the third surface 713, and the fourth surface 714 are smooth surfaces that allow smooth insertion of the developing cartridge 1 into the drawer unit 90.

<4. Drawer Unit>

Figure 7:
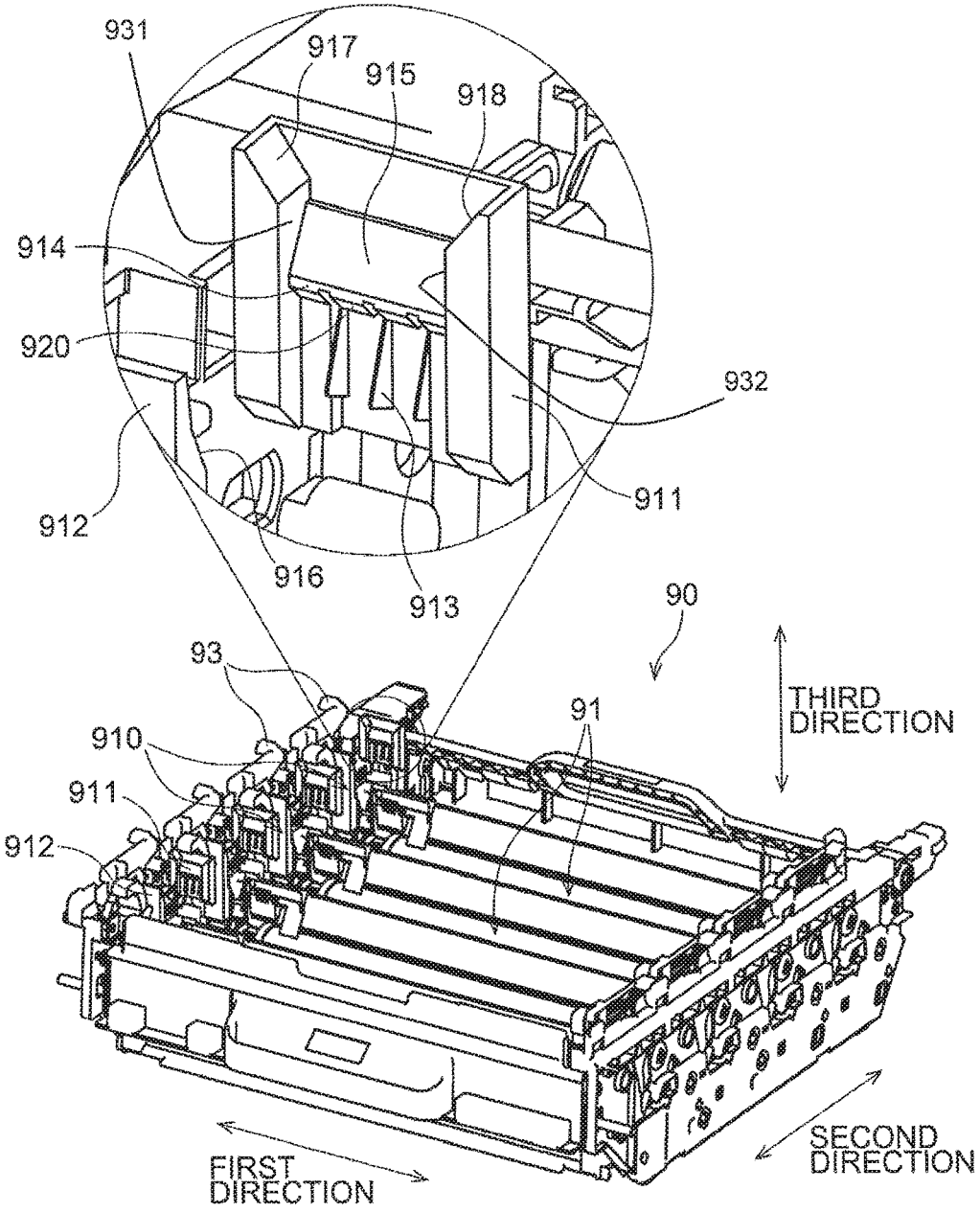
FIG. 7 is a perspective view depicting the drawer unit in the illustrative embodiment according to one or more aspects of the disclosure.

FIG. 7 is a perspective view depicting the drawer unit 90. As described above, the drawer unit 90 has four slots 91 into which the respective developing cartridges 1 are attachable. Each of the slots 91 has an opening 910 through which a corresponding one of the developing cartridges 1 enters. Each of the slot 91 has the opening 910 at its end farther from the photosensitive drum 92 in the third direction. Each of the slots 91 includes a first guide plate 911 and a second guide plate 912. The first guide plate 911 and the second guide plate 912 are disposed at one end of each of the slots 91 in the first direction.

Figure 8:
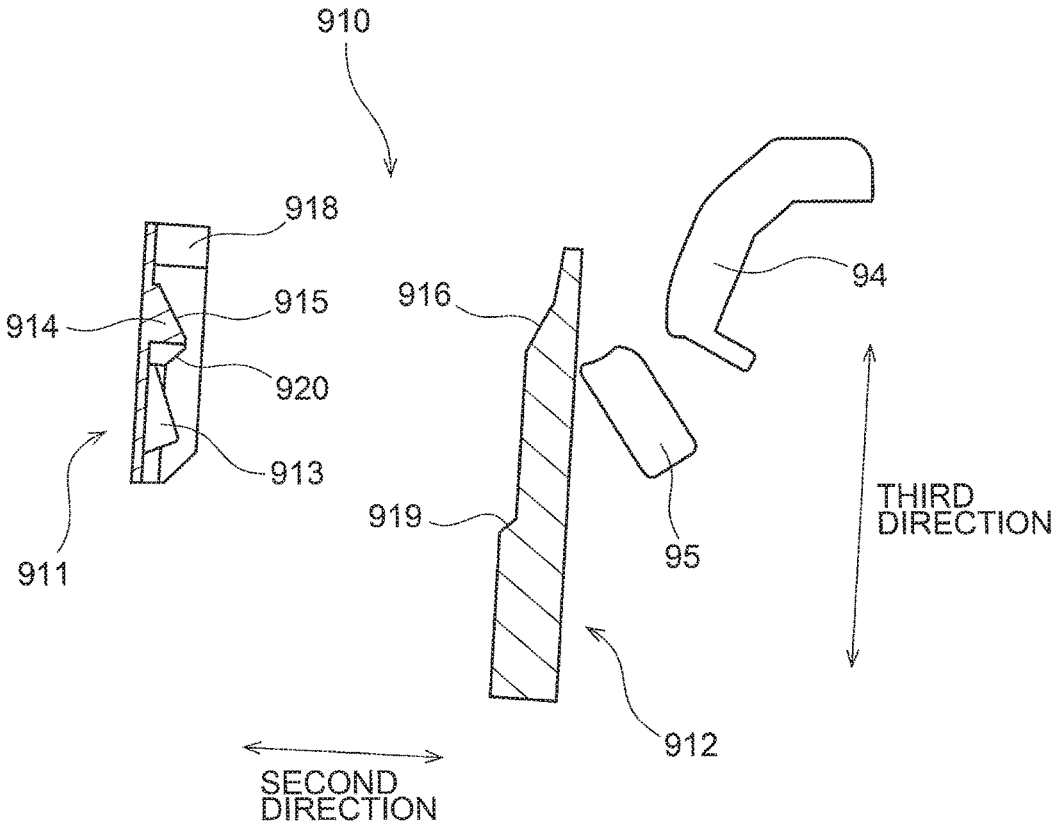
FIG. 8 is a sectional view depicting a first guide plate and a second guide plate in the illustrative embodiment according to one or more aspects of the disclosure.

FIG. 8 is a sectional view depicting the first guide plate 911 and the second guide plate 912 in a direction orthogonal to the first direction. As depicted in FIGS. 7 and 8, the first guide plate 911 and the second guide plate 912 are spaced from and opposite to each other in the second direction. The first guide plate 911 and the second guide plate 912 each extend both in the first direction and in the third direction.

The first guide plate 911 includes the terminal portion 913. The terminal portion 913 is an electrical contact contactable to the electrical contact surfaces 611 of the IC chip 61. The terminal portion 913 protrudes toward the second guide plate 912 in the second direction from the first guide plate 911. The terminal portion 913 is electrically connected to the controller 80 of the image forming apparatus 100. The terminal portion 913 is made of, for example, conductive metal.

As depicted in the enlarged view of FIG. 7 and in FIG. 8, the first guide plate 911 includes a guide protrusion 914. The guide protrusion 914 is positioned closer to the opening 910 than the terminal portion 913. The guide protrusion 914 protrudes toward the second guide plate 912 from the first guide plate 911. The first guide plate 911 has a first guide surface 915. In FIG. 8, the guide protrusion 914 has an inclined surface close to the opening 910. The inclined surface of the guide protrusion 914 is the first guide surface 915. The second guide plate 912 has a second guide surface 916. A distance between the first guide surface 915 and the second guide surface 916 in the second direction decreases gradually with distance closer to the photosensitive drum 92 along the third direction.

At the time of inserting the developing cartridge 1 into the drawer unit 90, the first external surface 710 of the holder 62 comes into contact with the first guide surface 915 and the second external surface 720 of the holder 62 comes into contact with the second guide surface 916. Thus, the distance between the first external surface 710 and the second external surface 720 in the second direction changes.

The first guide plate 911 has a third guide surface 917 and a fourth guide surface 918. At the time of inserting the developing cartridge 1 into the drawer unit 90, the third guide surface 917 and the fourth guide surface 918 position the holder 62 with respect to the first direction. The third guide surface 917 and the fourth guide surface 918 are positioned closer to the opening 910 than the first guide surface 915. The third guide surface 917 and the fourth guide surface 918 are spaced from each other in the first direction. A distance between the third guide surface 917 and the fourth guide surface 918 in the first direction decreases gradually with distance closer to the first guide surface 915. The first guide plate 911 has a sixth guide surface 931 and a seventh guide surface 932. The sixth guide surface 931 is contiguous with the third guide surface 917 and extends in the third direction. The seventh guide surface 932 is contiguous with the fourth guide surface 918 and extends in the third direction.

As depicted in FIG. 8, the second guide plate 912 has a stopper surface 919. The stopper surface 919 restricts movement of the holder 62 toward the photosensitive drum 92 after the developing cartridge 1 is attached to the drawer unit 90. The stopper surface 919 is positioned closer to the photosensitive drum 92 than the second guide surface 916. The stopper surface 919 extends toward the first guide plate 911 at its surface facing the first guide plate 911. As depicted in FIG. 8, the stopper surface 919 extends along the second direction and angled relative to the third direction.

Nevertheless, in other embodiments, for example, at least one of the first guide plate 911 and the second guide plate 912 may include a stopper surface. That is, the first guide plate 911 may include a stopper surface. In this case, the stopper surface is positioned closer to the photosensitive drum 92 than the terminal portion 913. The stopper surface may extend toward the second guide plate 912 at its surface facing the second guide plate 912.

The first guide plate 911 includes a fifth guide surface 920. The fifth guide surface 920 restricts movement of the holder 62 toward the opening 910 after the developing cartridge 1 is attached to the drawer unit 90. The fifth guide surface 920 is disposed between the terminal portion 913 and the first guide surface 915 in the third direction. In FIG. 8, the guide protrusion 914 has another inclined surface close to the terminal portion 913. The inclined surface of the guide protrusion 914 may be the fifth guide surface 920. Nevertheless, in other embodiments, for example, at least one of the first guide plate 911 and the second guide plate 912 includes the fifth guide surface 920.

As depicted in FIG. 7, the drawer unit 90 includes a plurality of separation levers 93. As depicted in FIG. 8, the drawer unit 90 includes a plurality of force application members 94 and a plurality of pressing members 95 (only one of the plurality of pressing members 95 is depicted in FIG. 8). The force application member 94 is disposed on each side of each of the slots 91 in the first direction. The pressing member 95 is disposed on each side of each of the slots 91 in the first direction. All of the separation levers 93, all of the force application members 94, and all of the pressing members 95 have the same or similar configuration and behave in the same or similar manner, respectively, and therefore, the description is provided with respect to ones corresponding to one of the developing cartridges 1. In a state where the developing cartridge 1 is attached to the drawer unit 90, the first cylindrical protrusion 46 is positioned between the force application member 94 and the pressing member 95 on one side of the slot 91 in the first direction and the second cylindrical protrusion 55 is positioned between the force application member 94 and the pressing member 95 on the other side of the slot 91 in the first direction. The force application members 94 urge the first cylindrical protrusion 46 and the second cylindrical protrusion 55, respectively, toward the photosensitive drum 92 in the third direction.

The pressing members 95 operate in synchronization with respective corresponding separation levers 93. At the time of a separating operation, the separation lever 93 is pressed by application of a driving force from the image forming apparatus 100. In response to this, the pressing members 95 move toward the force application members 94 in the third direction. Thus, the first cylindrical protrusion 46 and the second cylindrical protrusion 55 are pressed by the respective pressing members 95. Then, the first cylindrical protrusion 46 and the second cylindrical protrusion 55 move against the force applied by the respective force application members 94. Therefore, the casing 10 of the developing cartridge 1 and the developing roller 30 move in the third direction.

<5. Behavior of Drawer Unit and Developing Cartridge at Attachment>

Behavior of the drawer unit 90 and the developing cartridge 1 at the time of attaching the developing cartridge 1 to the drawer unit 90 will be described. FIGS. 9-15 each illustrate a state of the drawer unit 90 and one of the developing cartridges 1 at the time of attaching the developing cartridge 1 to the drawer unit 90.

Figure 9:
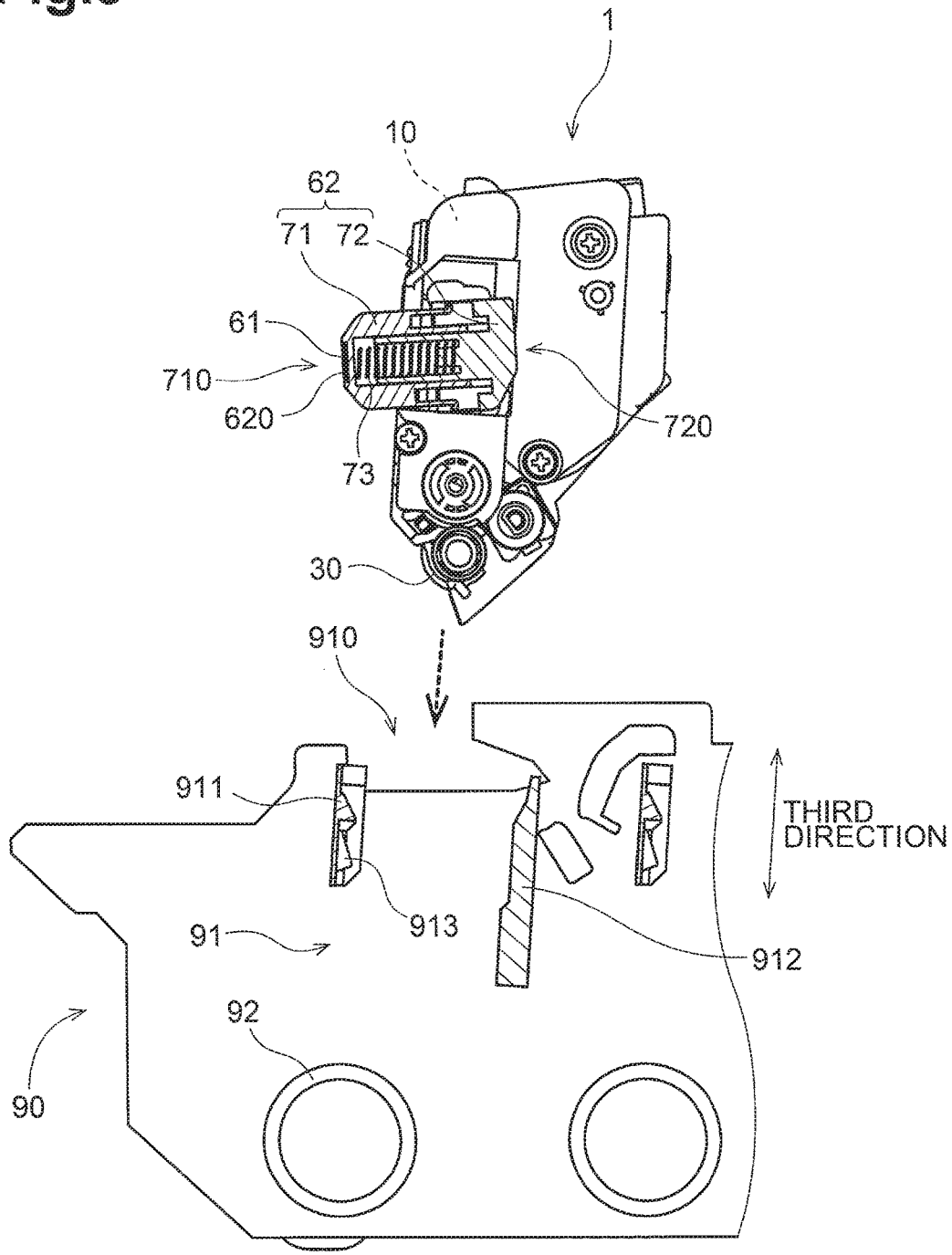
FIG. 9 illustrates a state of the drawer unit and a developing cartridge at the time of attaching the developing cartridge in the illustrative embodiment according to one or more aspects of the disclosure.

At the time of inserting the developing cartridge 1 into the slot 91, as depicted in FIG. 9, the developing cartridge 1 is positioned so as to face the opening 910 of the slot 91. At that time, the first external surface 710 and the second external surface 720 of the holder 62 are not in contact with the drawer unit 90. Therefore, the coil spring 73 is in the first state. The position of the holding surface 620 relative to the casing 10 in the second direction is the initial position. Then, the developing cartridge 1 is inserted into the slot 91 along the third direction as indicated by a dashed arrow in FIG. 9.

Figure 10:
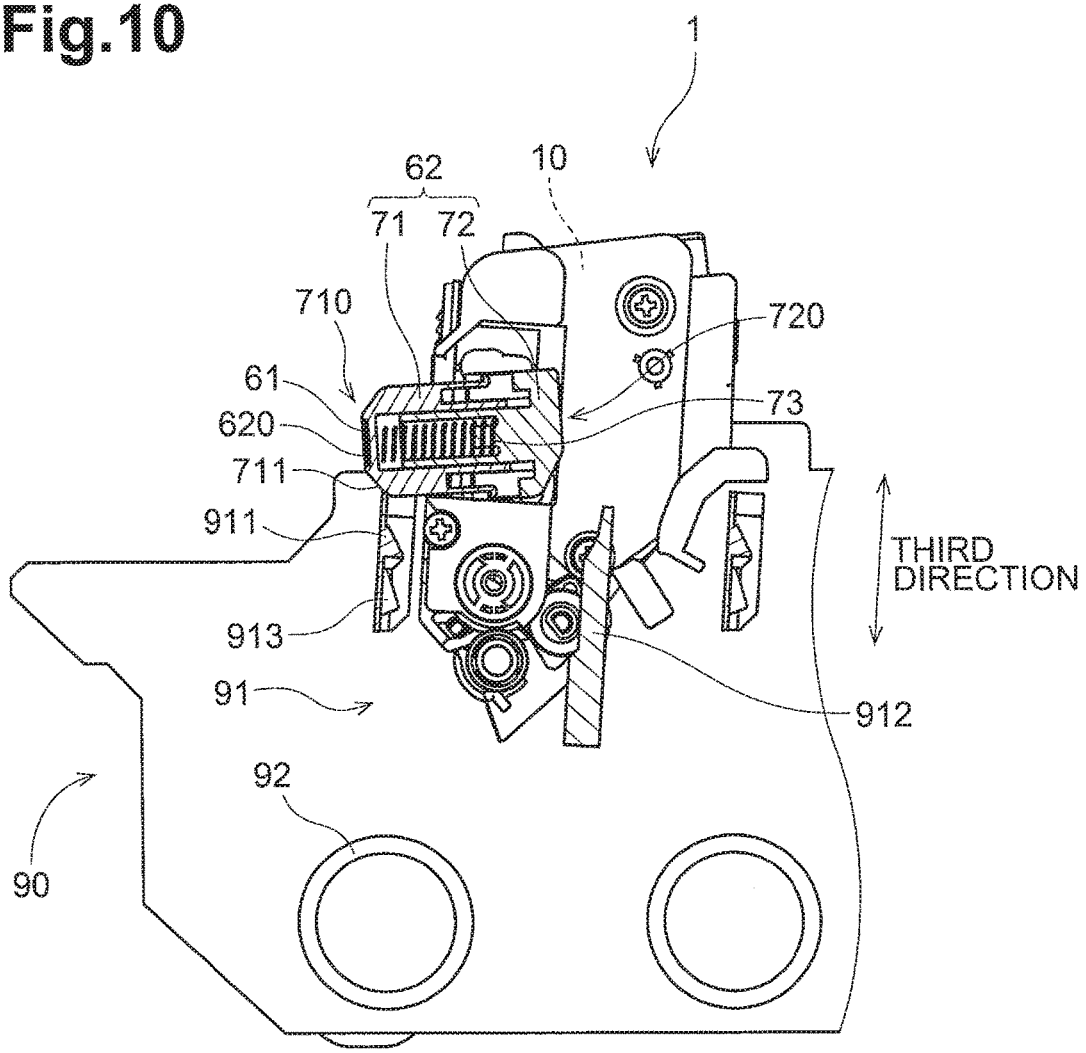
FIG. 10 illustrates positioning of the IC chip when attaching the developing cartridge in the illustrative embodiment according to one or more aspects of the disclosure.

As the developing cartridge 1 is inserted into the slot 91, as depicted in FIG. 10, the first surface 711 of the holder 62 comes into contact with an end (e.g., an upper end) of the first guide plate 911 in the third direction. Since the first surface 711 is pressed by the first guide plate 911, the holder 62 moves in the second direction. Meanwhile, the holder 62 moves relative to the casing 10. Thus, the holder 62 is positioned between the first guide plate 911 and the second guide plate 912 with respect to the second direction.

The holder 62 moves in the third direction while being in contact with the third guide surface 917 and the fourth guide surface 918. Thus, the holder 62 is positioned with respect to the first direction. As described above, in the illustrative embodiment, before the electrical contact surfaces 611 come into contact with the terminal portion 913, a part of the holder 62 is disposed between the sixth guide surface 931 and the seventh guide surface 932 in the first direction so that the holder 62 is positioned with respect to the first direction. Therefore, the electrical contact surfaces 611 are restricted to move in the first direction relative to the terminal portion 913 after the electrical contact surfaces 611 contact the terminal portion 913. Accordingly, a wearing of the electrical contact surfaces 611 is reduced.

Figure 11:
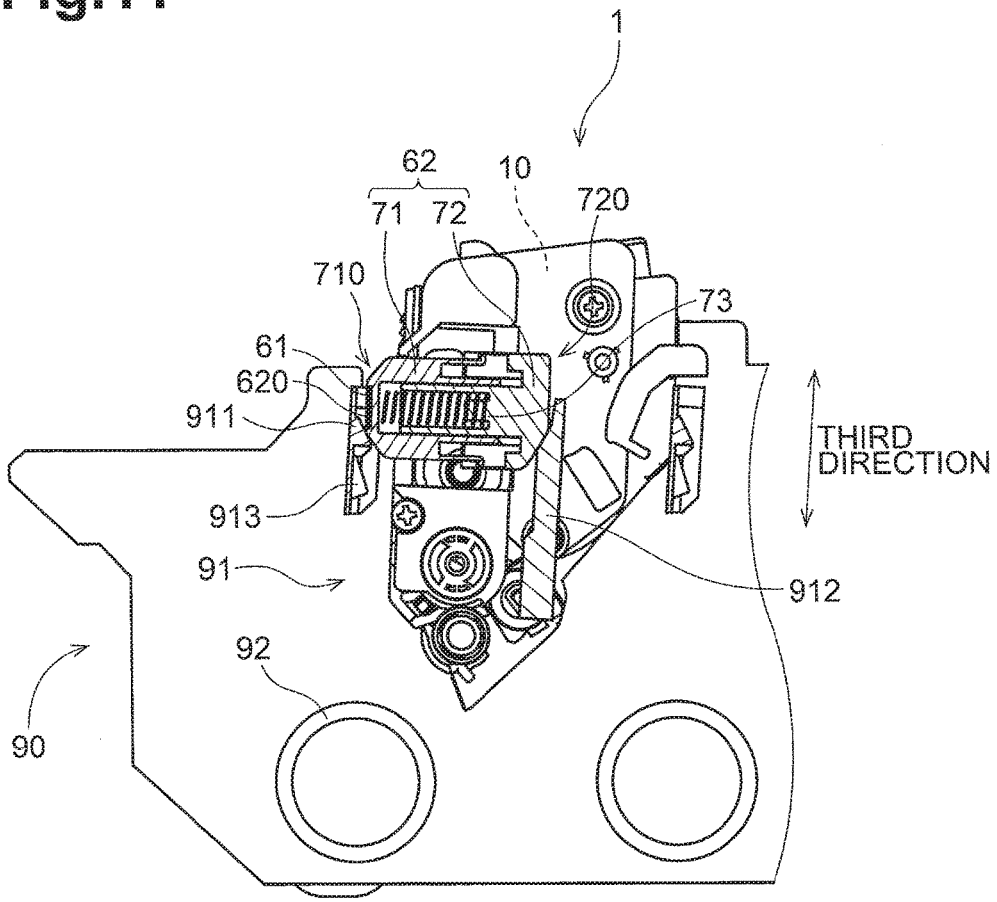
FIG. 11 illustrates still positioning of the IC chip when attaching the developing cartridge in the illustrative embodiment according to one or more aspects of the disclosure.

As depicted in FIG. 11, the first external surface 710 of the first holder member 71 contacts the first guide plate 911. The first external surface 710 moves in the third direction along a surface of the first guide plate 911. The second external surface 720 of the second holder member 72 contacts the second guide plate 912. The second external surface 720 moves in the third direction along a surface of the second guide plate 912. A distance between the first external surface 710 and the second external surface 720 in the second direction when the first external surface 710 moves in the third direction along a surface of the first guide plate 911 and the second external surface 720 moves in the third direction along a surface of the second guide plate 912 becomes shorter than the distance between the first external surface 710 and the second external surface 720 in the second direction when the coil spring 73 is in the first state. Therefore, the coil spring 73 further contracts in the second direction than the first state.

Figure 12:
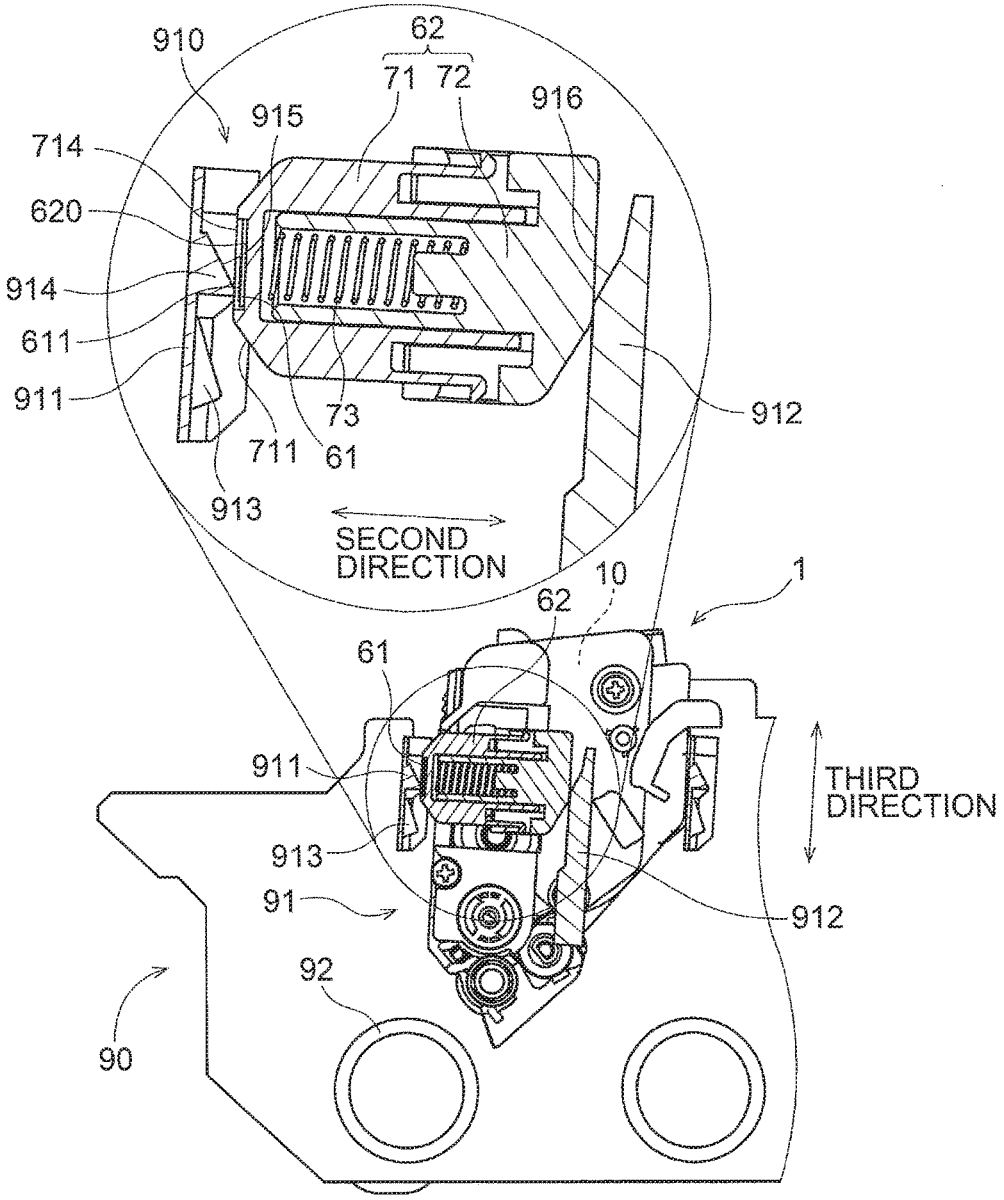
FIG. 12 illustrates yet positioning of the IC chip when attaching the developing cartridge in the illustrative embodiment according to one or more aspects of the disclosure.

As the developing cartridge 1 is further inserted along the third direction, the first holder member 71 comes into contact with the first guide surface 915 and the second holder member 72 comes into contact with the second guide surface 916. Thus, the first holder member 71 and the second holder member 72 come closer to each other in the second direction. That is, the first external surface 710 and the second external surface 720 come closer to each other in the second direction. Therefore, the coil spring 73 in the second direction is shortened gradually. As depicted in FIG. 12, when the third surface 713 and the fourth surface 714 of the first holder member 71 come into contact with the tip of the guide protrusion 914, the coil spring 73 is in the minimum length in the second direction. That is, the coil spring 73 is in a shortest-length state in which the coil spring 73 has a length shorter than the length of the coil spring 73 in the second state. In this state, the position of the holding surface 620 relative to the casing 10 in the second direction is the intermediate position.

As described above, at the time of inserting the developing cartridge 1 into the drawer unit 90, the IC chip assembly 60 may change the position of the holding surface 620 holding the IC chip 61 to another position with respect to the second direction. Therefore, the developing cartridge 1 is inserted into the drawer unit 90 while the position of the holding surface 620 with respect to the second direction is changed along the guide protrusion 914. Accordingly, a wearing of the electrical contact surfaces 611 of the IC chip 61 is reduced when the developing cartridge is inserted into the drawer unit 90.

In particular, the developing cartridge 1 according to the illustrative embodiment, the electrical contact surfaces 611 of the IC chip 61 are disposed at the portion recessed relative to the third surface 713 and the fourth surface 714. Therefore, in a state depicted in FIG. 12, while the top of the guide protrusion 914 is in contact with the third surface 713 and the fourth surface 714, the top of the guide protrusion 914 might not be in contact with the electrical contact surfaces 611. Accordingly, rubbing of the guide protrusion 914 against the electrical contact surfaces 611 is avoided.

Figure 13:
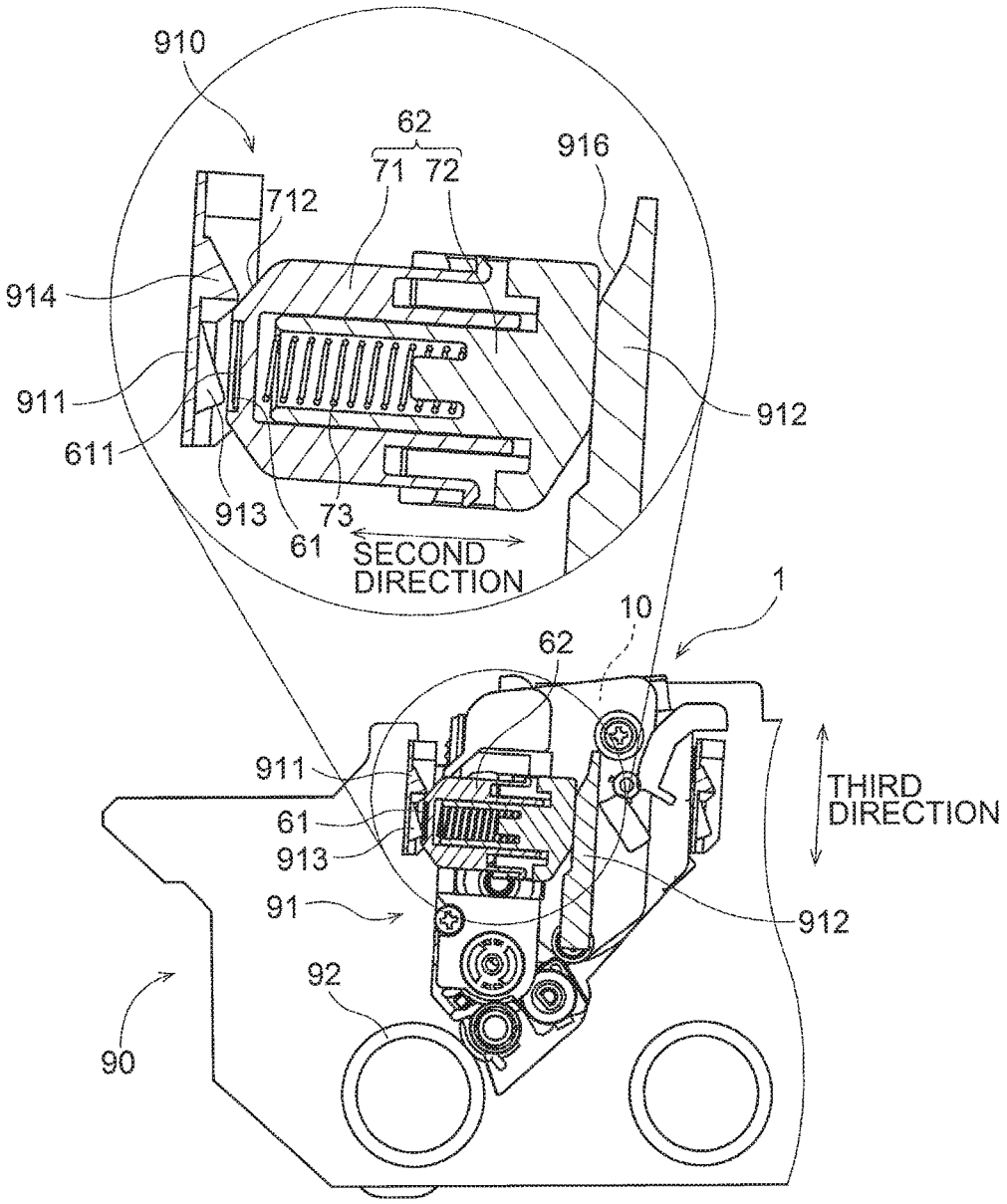
FIG. 13 illustrates further positioning of the IC chip when attaching the developing cartridge in the illustrative embodiment according to one or more aspects of the disclosure.
Figure 14:
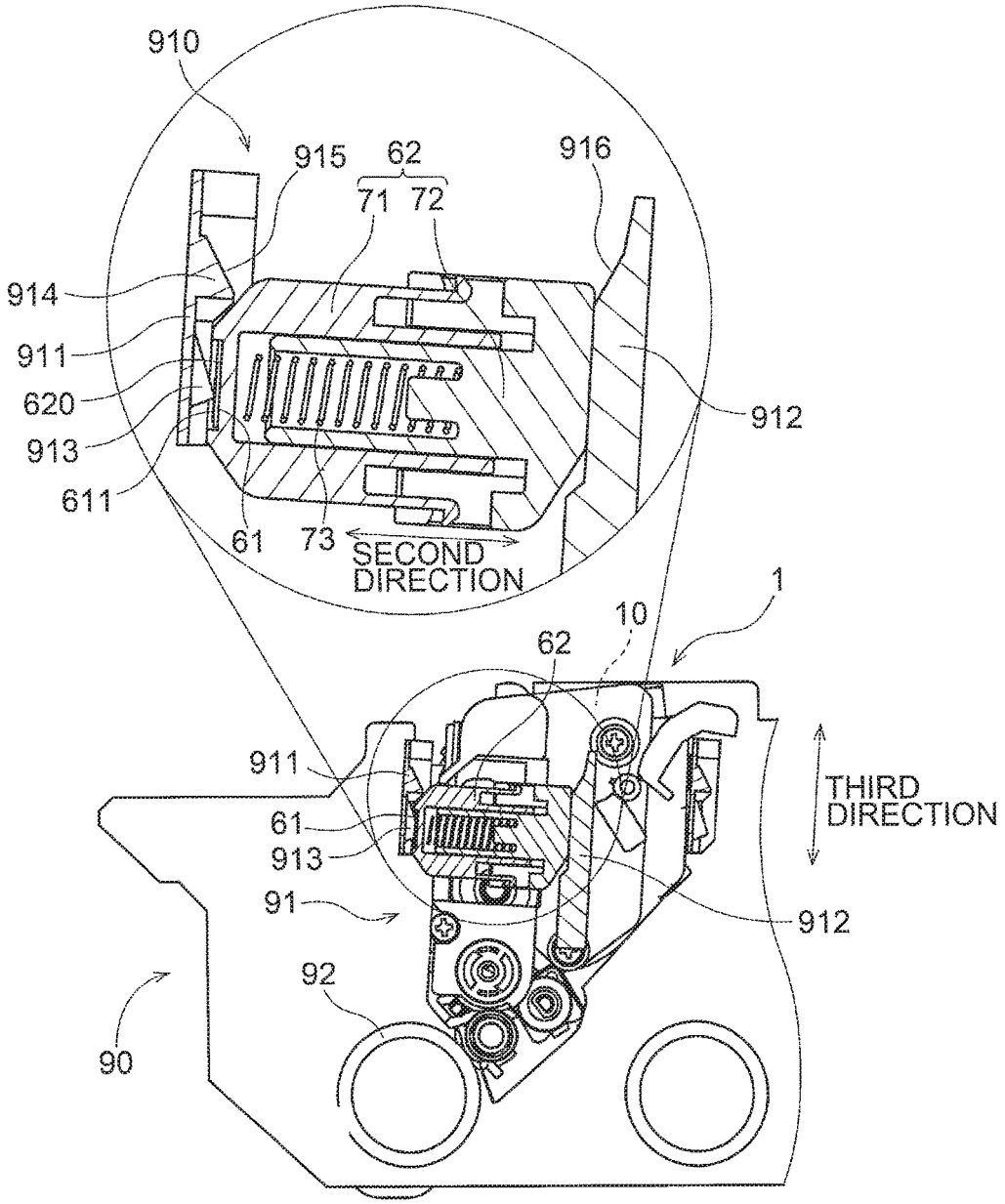
FIG. 14 illustrates still further positioning of the IC chip when attaching the developing cartridge in the illustrative embodiment according to one or more aspects of the disclosure.

Thereafter, as the developing cartridge 1 is further inserted along the third direction, the third surface 713 and the fourth surface 714 pass the guide protrusion 914. Then, as depicted in FIG. 13, the second surface 712 comes into contact with the guide protrusion 914. In response to this, the coil spring 73 expands again from the shortest-length state to become the second state. Thus, as depicted in FIG. 14, the electrical contact surfaces 611 of the IC chip 61 come into contact with the terminal portion 913. Accordingly, the controller 80 of the image forming apparatus 100 becomes capable of performing at least one of reading of information from the IC chip 61 and writing of information into the IC chip 61.

In the second state, the coil spring 73 has a length shorter than the length of the coil spring 73 in the first state with respect to the second direction and longer than the length of the coil spring 73 in the shortest-length state with respect to the second direction. When the coil spring 73 is in the second state, the position of the holding surface 620 relative to the casing 10 in the second direction is the contacting position.

As described above, the electrical contact surfaces 611 directly contact the terminal portion 913 after the first external surface 710 passes the guide protrusion 914. Therefore, after the electrical contact surfaces 611 contact the terminal portion 913, the position where the terminal portion 913 contacts the electrical contact surfaces 611 are not changed changed. Accordingly, a wearing of the electrical contact surfaces 611 is further reduced.

The distance between the terminal portion 913 and the second guide plate 912 in the second direction is shorter than the distance between the set of the electrical contact surfaces 611 and the second external surface 720 of the developing cartridge 1 which is not attached to the drawer unit 90. Therefore, in a state of FIG. 14, the coil spring 73 has a length shorter than its natural length in the second direction. Thus, the electrical contact surfaces 611 are pressed against the terminal portion 913 by an elastic force (e.g., a resilient force) of the coil spring 73. Accordingly, the electrical contact surfaces 611 and the terminal portion 913 is kept in contact with each other appropriately.

The IC chip assembly 60 is fixed while being disposed between the terminal portion 913 and the second guide plate 912. After the developing cartridge 1 is inserted into the drawer unit 90 completely, in the illustrative embodiment, the casing 10 is tilted in a direction indicated by a dashed arrow in FIG. 15 with respect the second direction. Thus, the developing roller 30 comes into contact with the photosensitive drum 92 of the drawer unit 90. At that time, the position of the holding surface 620 relative to the casing 10 in the second direction changes from the contacting position to the final position. The first boss 621*a* moves in the second direction within the first through hole 451*a*. The second boss 621*b* moves in the second direction within the second through hole 451*b*. The third boss 621*c* moves in the second direction within the recessed portion 15. Thus, the holder 62 becomes separate from the casing 10 and the first cover 45. Therefore, vibrations might not hardly be transmitted to the IC chip assembly 60 from the drive unit, e.g., the first gear unit 40, during execution of printing processing in the image forming apparatus 10. Accordingly, the electrical contact surfaces 611 and the terminal portion 913 are kept in contact with each other further appropriately.

<6. Separating Operation>

After the developing cartridge 1 is attached to the drawer unit 90 completely, the image forming apparatus 100 is capable of performing a "separating operation" in which the developing roller 30 is separated from the photosensitive drum 92 temporarily.

Figure 15:
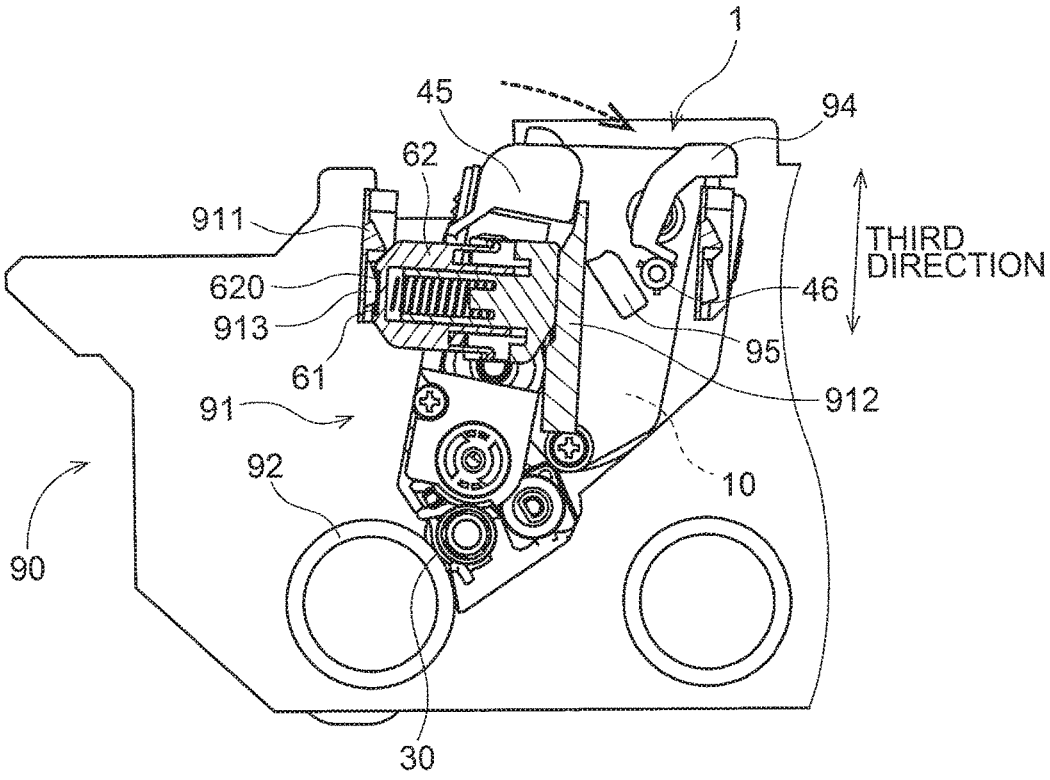
FIG. 15 illustrates yet further positioning of the IC chip when attaching the developing cartridge in the illustrative embodiment according to one or more aspects of the disclosure.

After the casing 10 is tilted in the direction indicated by the dashed arrow in FIG. 15, the first cylindrical protrusion 46 and the second cylindrical protrusion 55 are in contact with the respective force application members 94. The force application members 94 urge the first cylindrical protrusion 46 and the second cylindrical protrusion 55, respectively, toward the photosensitive drum 92. Therefore, the developing roller 30 is pressed against the photosensitive drum 92. That is, the developing roller 30 and the photosensitive drum 92 are kept in contact with each other (e.g., a contacting state).

Figure 16:
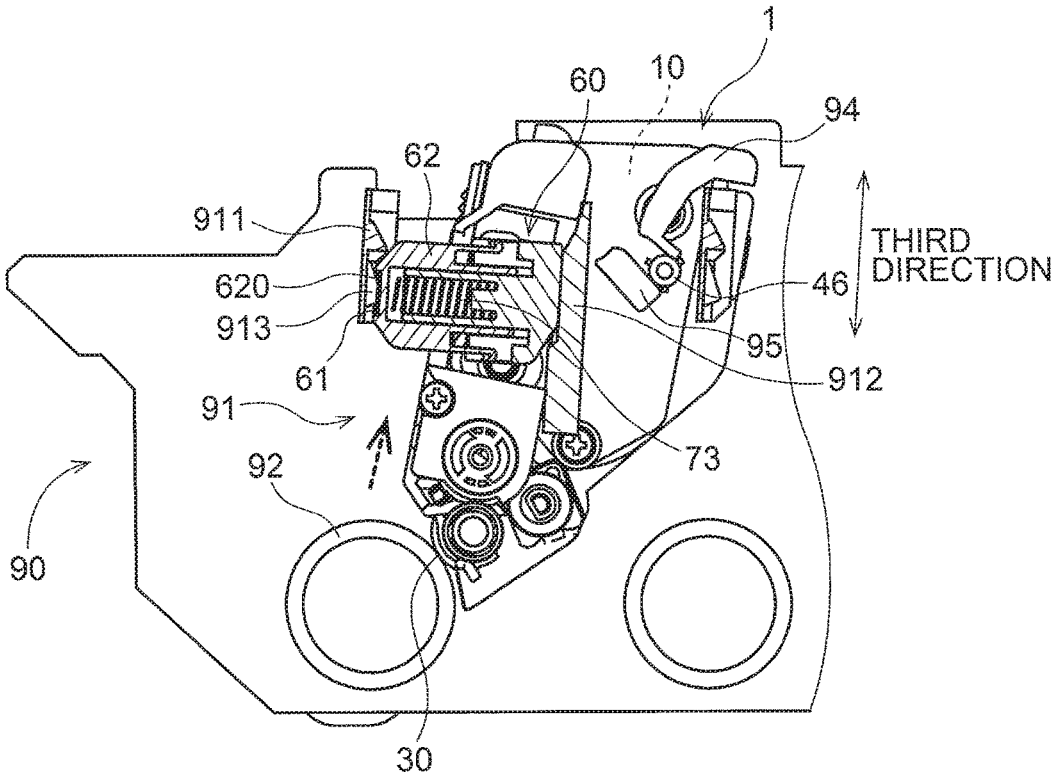
FIG. 16 illustrates a state of the drawer unit and the developing cartridge at the time of a separating operation in the illustrative embodiment according to one or more aspects of the disclosure.

FIG. 16 illustrates a state of the drawer unit 90 and the developing cartridge 1 at the time the separating operation. At the separating operation, the separation lever 93 is pressed by application of a driving force from the image forming apparatus 100. Thus, the pressing members 95 move toward the respective force application members 94 in the third direction. Therefore, the pressing member 95 disposed on the one side of the slot 91 in the first direction comes into contact with the first cylindrical protrusion 46 and presses the first cylindrical protrusion 46 toward the opening 910 against the pressure of the force application member 94. The pressing member 95 disposed on the other side of the slot 91 in the first direction comes into contact with the second cylindrical protrusion 55 and presses the first cylindrical protrusion 46 toward the opening 910 against the pressure of the force application member 94. Thus, the casing 10 and the developing roller 30 of the developing cartridge 1 move in a direction indicated by a dashed arrow in FIG. 16 with respect to the third direction. Therefore, the developing roller 30 and the photosensitive drum 92 are separated from each other (e.g., are kept in a separated state).

In both of the contacting state and the separated state, while the IC chip assembly 60 is fixed between the terminal portion 913 and the second guide plate 912 and the electrical contact surfaces 611 are in contact with the terminal portion 91, the holder 62 might not be in contact with the casing 10 and the first cover 45 and the first guide plate 911 and the second guide plate 912 might not also be in contact with the casing 10 and the first cover 45. Therefore, at the separating operation, the casing 10 is movable relative to the holder 62 while the holder 62 is fixed between the first guide plate 911 and the second guide plate 912.

That is, at the separating operation, while the casing 10 and the developing roller 30 move in the third direction, the position of the IC chip assembly 60 relative to the drawer unit 90 is not changed and the state of the coil spring 73 is not also changed from the second state. That is, while the positions of the electrical contact surfaces 611 relative to the drawer unit 90 are fixed, the position of the casing 10 with respect to the third direction is changed. Accordingly, the electrical contact surfaces 611 and the terminal portion 913 are kept in contact with each other. A wearing of the electrical contact surfaces 611 that may occur at the separating operation is reduced.

During shipping the image forming apparatus 100 in a state where the developing cartridge 1 is attached to the drawer unit 90, the electrical contact surfaces 611 and the terminal portion 913 are kept in contact with each other. Accordingly, a wearing of the electrical contact surfaces 611 is further reduced.

In the illustrative embodiment, the direction in which the developing roller 30 separates from the photosensitive drum 92 at the separating operation (i.e., a separating direction) corresponds to the third direction. Nevertheless, the separating direction is any direction other than the third direction. In other embodiments, for example, the separating direction is a direction intersecting a direction in which the electrical contact surfaces 611 and the terminal portion 913 face each other.

<7. Variations>

While the disclosure has been described in detail with reference to the specific embodiment thereof, this is merely an example, and various changes, arrangements and modifications are applied therein without departing from the spirit and scope of the disclosure. Hereinafter, variations of the illustrative embodiment will be described. An explanation will be given mainly for the parts different from the illustrative embodiment.

In the illustrative embodiment, the first guide surface 915 and the second guide surface 916 are both angled relative to the third direction. Nevertheless, in other embodiments, for example, one of the first guide surface 915 and the second guide surface 916 may extend parallel to the third direction and the other of the first guide surface 915 and the second guide surface 916 are angled relative to the third direction. In the illustrative embodiment, the first guide surface 915 and the second guide surface 916 are both flat surfaces. Nevertheless, in other embodiments, for example, one or both of the first guide surface 915 and the second guide surface 916 is/are a curved surface.

In the illustrative embodiment, the first boss 621*a* and the second boss 621*b* of the holder 62 are positioned in the first through hole 451*a* and the second through hole 451*b*, respectively, of the first cover 45. Nevertheless, in other embodiments, for example, a first cover includes bosses and a holder may have through holes and/or recessed portions for receiving the bosses. In the illustrative embodiment, the third boss 621*c* of the holder 62 is positioned in the recessed portion 15 of the casing 10. Nevertheless, in other embodiments, for example, a casing includes a boss and a holder may have a through hole or recessed portion for receiving the boss.

In the illustrative embodiment, the coil spring 73 is used as the elastic member. Nevertheless, in other embodiments, for example, instead of the coil spring 73, another spring, e.g., a leaf spring or a torsion spring, is used as the elastic member. In other embodiments, for example, an IC chip assembly do not necessarily include an elastic member. That is, the IC chip assembly is not necessarily capable of expanding and contracting in the second direction. In this case, an image forming apparatus may include a mechanism for applying an external force to the IC chip assembly for pressing electrical contact surfaces against a terminal portion.

In the illustrative embodiment, the developing cartridge 1 is attached to the drawer unit 90. Nevertheless, in other embodiments, for example, a developing cartridge is attached to a drum cartridge including a photosensitive drum. The drum cartridge having the developing cartridge attached thereto is further attached to an image forming apparatus. In other embodiments, for example, a developing cartridge is directly attached to a body of an image forming apparatus without a drawer unit or a drum cartridge. A photosensitive drum is attached to a body of an image forming apparatus.

In the illustrative embodiment, the IC chip 61 including the electrical contact surfaces 611 is fixed to the first external surface 710 of the holder 62. Nevertheless, in other embodiments, for example, only electrical contact surfaces is fixed on the first external surface 710 of the holder 62 and the other portion of an IC chip is disposed at an appropriate portion of a developing cartridge. In other embodiments, for example, electrical contact surfaces is electrodes other than the storage medium of the IC chip 60, for example, electrodes for supply electric power to the developing roller 30. In this case, the electrical contact surfaces is electrically connected to the developing roller 30 via a harness.

In the illustrative embodiment, the gears of the first gear unit 40 are capable of engaging with the gears of the second gear unit 50 are through their interlocking teeth. Nevertheless, in other embodiments, for example, gears of the first gear unit 40 engage with gears of the second gear unit 50 in another manner, for example, through their frictional force. In one example, the gears of the first gear unit 40 and the gears of the second gear unit 50 may each include a friction member (e.g., rubber) on its circumference, instead of the teeth.

In the illustrative embodiment, at the separating operation, while the electrical contact surfaces 611 and the terminal portion 913 are kept in the contacting state, the casing 10 is moved in the third direction relative to the holder 62. Nevertheless, in other embodiments, for example, while the electrical contact surfaces 611 and the terminal portion 913 are kept in the contacting state for another purpose than the separating operation, the casing 10 is movable in the third direction relative to the holder 62.

The details of the components constituting the image forming apparatus 100 are merely example and are not limited to the specific example. In other embodiments, for example, the components may have different details from the components depicted in the drawings. The components of the illustrative embodiment and the components of the variations is used in appropriate combination.

What is claimed is:

1. An image forming apparatus comprising:

a photosensitive drum rotatable about a first axis extending in a first direction;

a developing cartridge comprising:

a casing configured to store developer therein;

a developing roller rotatable about a second axis extending in the first direction;

a storage medium comprising an electrical contact surface; and a holder disposed at one end of the casing in the first direction, the holder having a first external surface, the holder holding the electrical contact surface on the first external surface; and a frame to which the developing cartridge is attachable, the frame having an electrical contact, the electrical contact being configured to contact the electrical contact surface of the developing cartridge when the developing cartridge is attached to the frame, wherein the holder is configured to bias the electrical contact surface of the storage medium in a second direction toward the electrical contact of the frame such that as the casing is moved relative to the holder in a separating direction, the separating direction being different from the second direction, in which the developing roller separates from the photosensitive drum, the developing cartridge is in a state where the electrical contact surface remains in contact with the electrical contact.

2. The image forming apparatus according to claim 1, wherein the holder comprises a second external surface and an elastic member, the second external surface disposed at an opposite end to the one end of the holder in a second direction and movable relative to the first external surface in the second direction, the elastic member disposed between the first external surface and the second external surface in the second direction, the elastic member is capable of expanding and contracting in the second direction, and wherein the electrical contact surface come into contact with the electrical contact by an elastic force of the elastic member.

3. The image forming apparatus according to claim 1, further comprising a pressing member pressing the casing in the separating direction.

4. The image forming apparatus according to claim 3, wherein the casing is configured to move by the force of the pressing member between a first state where the photosensitive drum is separated from the developing roller and a second state where the photosensitive drum is in contact with the developing roller, the electrical contact surfaces being in contact with the electrical contact both in the first state and in the second state.

5. The image forming apparatus according to claim 1, wherein the storage medium is an IC chip.

6. The image forming apparatus according to claim 1, wherein photosensitive drum is arranged in the frame.

7. The image forming apparatus according to claim 1, wherein the frame defines a plurality of slots in which the developing cartridge is attachable, and wherein the photosensitive drum is disposed in a respective one of the plurality of slots in which the developing cartridge is attached.

8. An image forming apparatus comprising:

a photosensitive drum rotatable about a first axis extending in a first direction;

a developing cartridge comprising:

a casing configured to store developer therein;

a developing roller rotatable about a second axis extending in the first direction;

a storage medium comprising an electrical contact surface; and a holder disposed at one end of the casing in the first direction, the holder having a first external surface, the holder holding the electrical contact surface on the first external surface, wherein the casing is movable relative to the holder in a separating direction in which the developing roller separates from the photosensitive drum while the developing cartridge is in a state where the electrical contact surface remains in contact with an electrical contact, and wherein the holder comprises a second external surface and an elastic member, the second external surface disposed at an opposite end to a one end of the holder in a second direction and movable relative to the first external surface in the second direction, the elastic member disposed between the first external surface and the second external surface in the second direction, the elastic member is capable of expanding and contracting in the second direction; and a frame to which the developing cartridge is attachable, the frame having the electrical contact, the electrical contact being configured to contact the electrical contact surface of the developing cartridge when the developing cartridge is attached to the frame, wherein the electrical contact surface comes into contact with the electrical contact by an elastic force of the elastic member, wherein the frame has a first guide plate and a second guide plate, the first guide plate having the electrical contact, the second guide plate capable of contacting the second external surface, and wherein a distance between the electrical contact and the second guide plate in the second direction is shorter than a distance between the electrical contact surfaces and the second external surface in a state that the developing cartridge is removed from the frame.

9. The image forming apparatus according to claim 8, wherein the first external surface and the second external surface are configured to come closer to each other in the second direction and a length of the elastic member in the second direction is shortened as the second external surface moves along the second guide plate in an inserted direction where the developing cartridge is inserted to the frame.

10. The image forming apparatus according to claim 8, wherein the casing is configured to move relative to the holder in the separating direction both in a state that the holder is fixed between the first guide plate and the second guide plate and in a state that the second external surface is in contact with the second guide plate and the electrical contact surfaces is in contact with the electrical contact.

11. The image forming apparatus according to claim 8, wherein the developing cartridge further comprises a first cover holding the holder between the casing and the first cover, the first cover being fixed to the casing, and wherein the casing and the first cover move in the separating direction relative to the holder both in a state that the holder is fixed between the first guide plate and the second guide plate and in a state that the electrical contact surfaces is in contact with the electrical contact.

12. An image forming apparatus comprising:

a developing cartridge comprising:

a casing configured to storing developer therein;

a developing roller rotatable about an axis extending in a first direction;

a storage medium comprising an electrical contact surface; and a holder disposed at one end of the casing in the first direction, the holder having a first external surface disposed at one end of the holder in a second direction, the holder holding the electrical contact surface on the first external surface; and a frame configured to receive the developing cartridge inserted in a inserted direction, wherein the frame comprises an electrical contact, the electrical contact being configured to contact the electrical contact surface of the developing cartridge in a state where the developing cartridge is attached to the frame, and wherein the holder is configured to bias the electrical contact surface of the storage medium in a second direction toward the electrical contact of the frame such that as the casing is moved relative to the holder in the inserted direction, the inserted direction being different from the second direction, the casing is in a state where the electrical contact surface is in contact with the electrical contact.

13. An image forming apparatus comprising:

a developing cartridge comprising:

a casing configured to store developer therein;

a developing roller;

an electrical contact surface; and a holder holding the electrical contact surface; and a frame to which where the developing cartridge is attachable, wherein the frame comprises an electrical contact, the electrical contact being configured to be in contact with the electrical contact surface of the developing cartridge in a state where the developing cartridge is attached to the frame, and wherein the holder is configured to bias the electrical contact surface of the storage medium in a second direction toward the electrical contact of the frame such that as the casing is moved relative to the holder in an inserted direction, the inserted direction being different from the second direction, the electrical contact surface faces the electrical contact in a state where the electrical contact surface is in contact with the electrical contact.

* * * * *